US010208599B2

(12) United States Patent
Davis

(10) Patent No.: US 10,208,599 B2
(45) Date of Patent: Feb. 19, 2019

(54) HEAT ENGINE WITH LINEAR ACTUATORS

(71) Applicant: Brian Davis, Ripon, WI (US)

(72) Inventor: Brian Davis, Ripon, WI (US)

( * ) Notice: Subject to any disclaimer, the term of this patent is extended or adjusted under 35 U.S.C. 154(b) by 763 days.

(21) Appl. No.: 14/193,247

(22) Filed: Feb. 28, 2014

(65) Prior Publication Data

US 2014/0178237 A1 Jun. 26, 2014

Related U.S. Application Data

(63) Continuation-in-part of application No. 13/469,306, filed on May 11, 2012, now Pat. No. 8,978,618.

(60) Provisional application No. 61/772,740, filed on Mar. 5, 2013, provisional application No. 61/485,849, filed on May 13, 2011.

(51) Int. Cl.

| | |
|---|---|
| ***F02G 1/053*** | (2006.01) |
| ***F01K 23/10*** | (2006.01) |
| ***F01C 1/22*** | (2006.01) |
| ***F01C 21/18*** | (2006.01) |
| ***F02G 1/043*** | (2006.01) |

(52) U.S. Cl.

CPC ..... *F01C 21/18* (2013.01); *F01C 1/22* (2013.01); *F02G 1/043* (2013.01)

(58) Field of Classification Search

CPC ..... F02B 2053/005; F02B 53/00; F02B 2730/018; F02G 1/043; F02G 2270/02; F02G 1/02; F02G 1/04; Y02T 10/17; F16D 48/064; F25B 9/14; F16H 19/02; F16H 31/001; Y10T 74/1529; Y10T 74/1532; Y10T 74/1884; Y10T 74/18848

USPC ..... 418/61.2, 29; 62/6; 74/128, 130, 89.2, 74/89.21; 91/363 R; 60/670

See application file for complete search history.

(56) References Cited

U.S. PATENT DOCUMENTS

| | | | | |
|---|---|---|---|---|
| 658,556 | A | 9/1900 | Pitt | |
| 2,042,116 | A | 5/1936 | Morris | |
| 2,988,065 | A | 6/1961 | Wankel | |
| 3,148,595 | A | 9/1964 | Looney | |
| 3,267,816 | A | 8/1966 | Graham | |
| 3,267,817 | A | 8/1966 | Adams | |
| 3,426,525 | A * | 2/1969 | Rubin | 60/519 |
| 3,483,694 | A | 12/1969 | Huber | |
| 3,509,718 | A * | 5/1970 | Hohenhinnebusch et al. | 60/519 |

(Continued)

FOREIGN PATENT DOCUMENTS

| | | |
|---|---|---|
| DE | 4119242 | 6/1992 |
| WO | 8606437 | 6/1986 |
| WO | 2005003598 | 1/2005 |

*Primary Examiner* — Thai Ba Trieu

(74) *Attorney, Agent, or Firm* — Brannen Law Office, LLC

(57) ABSTRACT

The present invention relates to a heat engine having shafts with gears, position gears and a plurality of actuators. Energy is harnessed from the first shaft as it rotates. The second shaft can be coupled to the first shaft to transfer energy from the second shaft to the first shaft. One coupler is a chain. Position gears orient the chain wherein the rotation of the second shaft is inverted upon the first shaft so that the first shaft has a constant rotational orientation. Each actuator is preferably a double acting actuator that can supply force to both push and pull upon a belt connected to the actuator rod. A 1-way clutch and gear connects the belt to each shaft wherein the belt (driven by actuator) imparts a positive force upon the first shaft on the out stroke and a positive force upon the second shaft on the return stroke.

18 Claims, 43 Drawing Sheets

(56) References Cited

U.S. PATENT DOCUMENTS 3,698,184 A 10/1972 Barrett
3,762,167 A 10/1973 Wahnschaffe et al.
3,763,649 A 10/1973 Wahnschaffe et al.
3,800,526 A 4/1974 Wahnschaffe et al.
3,811,272 A 5/1974 Hakansson
3,830,059 A 8/1974 Spriggs
3,831,500 A 8/1974 Kitamura et al.
3,924,578 A 12/1975 Howard
3,939,719 A 2/1976 Stovall
3,958,421 A 5/1976 Kelly
3,973,445 A * 8/1976 Ballard ..... 74/89.21
3,990,239 A 11/1976 Pattas et al.
4,044,559 A 8/1977 Kelly
4,059,370 A 11/1977 Gibson
4,103,491 A 8/1978 Ishizaki
4,156,265 A * 5/1979 Rose ..... H01R 33/962 361/179
4,179,890 A 12/1979 Hanson
4,206,604 A 6/1980 Reich
4,206,606 A * 6/1980 Yamada ..... 60/605.2
4,225,110 A 9/1980 Akkerman et al.
4,240,256 A 12/1980 McDougal
4,357,800 A * 11/1982 Hecker ..... 60/519
4,380,909 A 4/1983 Sung
4,702,147 A * 10/1987 Johnson et al. ..... 91/318
4,721,086 A 1/1988 Scarnera et al.
4,753,073 A 6/1988 Chandler
4,760,701 A * 8/1988 David ..... 60/595
5,031,470 A 7/1991 Karlsson
5,165,238 A 11/1992 Paul et al.
5,167,107 A * 12/1992 Terminella ..... B29C 65/18 74/110
5,168,846 A 12/1992 Paul et al.
5,176,581 A * 1/1993 Kumm ..... F16H 9/14 474/110
5,211,017 A * 5/1993 Pusic ..... 60/519
5,325,671 A * 7/1994 Boehling ..... 60/682
5,335,497 A 8/1994 Macomber
5,410,998 A 5/1995 Paul et al.
5,461,863 A 10/1995 Simonds
6,109,040 A * 8/2000 Ellison et al. ..... 62/6
6,523,451 B1 * 2/2003 Liao ..... F15B 9/09 91/363 R
6,568,169 B2 5/2003 Conde et al.
6,758,188 B2 7/2004 Wooldridge
6,834,503 B2 12/2004 Freymann
6,938,588 B2 * 9/2005 Jacobsen ..... F01B 11/00 123/305
7,261,070 B2 * 8/2007 Jones ..... F02B 71/00 123/46 SC
7,669,415 B2 3/2010 Komaki et al.
7,919,938 B2 * 4/2011 Harvey ..... F02K 1/763 239/265.19
8,201,523 B2 * 6/2012 Cohen ..... F02B 63/04 123/2
8,240,223 B2 * 8/2012 Jones ..... B64C 13/28 244/110 B
8,312,859 B2 11/2012 Rom et al.
8,333,256 B2 * 12/2012 Stolkin ..... B62D 55/075 180/6.7
2004/0050358 A1 3/2004 Harrison
2004/0055316 A1 * 3/2004 Emmer ..... F17C 7/04 62/50.6
2006/0156727 A1 * 7/2006 Jacobsen ..... F22B 1/18 60/670
2007/0113560 A1 5/2007 Steber et al.
2007/0234719 A1 10/2007 Schuster et al.
2008/0190395 A1 8/2008 Rom et al.
2009/0056670 A1 3/2009 Zhao et al.
2009/0139227 A1 6/2009 Nakasuka et al.
2009/0313989 A1 12/2009 Doss
2009/0322098 A1 * 12/2009 Cohen ..... F02B 63/04 290/1 A
2010/0089062 A1 4/2010 Cao
2010/0300097 A1 12/2010 Van De Loo et al.
2011/0126794 A1 6/2011 Higashi et al.
2011/0314810 A1 * 12/2011 McBride ..... F15B 11/06 60/641.1
2012/0031091 A1 * 2/2012 Mungas ..... F02G 1/053 60/517
2012/0223529 A1 * 9/2012 Cohen ..... F02B 63/04 290/1 A
2012/0291572 A1 11/2012 Baker et al.
2012/0304967 A1 12/2012 Devine
2018/0045284 A1 * 2/2018 Rosengren ..... F16H 19/06

* cited by examiner

| distance | power 1 | power 2 | power 3 | power 4 | combined horsepower |
|---|---|---|---|---|---|
| 0.1 | 7.87 | 4.16 | 7.45 | 7.62 | 27.11 |
| 0.2 | 7.87 | 4.09 | 7.29 | 7.62 | 26.87 |
| 0.3 | 7.87 | 4.02 | 7.14 | 7.62 | 26.65 |
| 0.4 | 7.87 | 3.95 | 6.99 | 7.62 | 26.42 |
| 0.5 | 7.87 | 3.88 | 6.84 | 7.62 | 26.21 |
| 0.6 | 7.87 | 3.81 | 6.70 | 7.62 | 26.00 |
| 0.7 | 7.87 | 3.74 | 6.56 | 7.62 | 25.80 |
| 0.8 | 7.87 | 3.68 | 6.43 | 7.62 | 25.60 |
| 0.9 | 7.87 | 3.62 | 6.30 | 7.62 | 25.41 |
| 1.0 | 7.87 | 3.56 | 6.17 | 7.62 | 25.22 |
| 1.1 | 7.87 | 3.50 | 6.05 | 7.62 | 25.04 |
| 1.2 | 7.87 | 3.44 | 5.93 | 7.62 | 24.86 |
| 1.3 | 7.87 | 3.38 | 5.81 | 7.62 | 24.68 |
| 1.4 | 7.87 | 3.32 | 5.70 | 7.62 | 24.51 |
| 1.5 | 7.87 | 3.27 | 5.59 | 7.62 | 24.35 |
| 1.6 | 7.87 | 3.21 | 5.48 | 7.62 | 24.19 |
| 1.7 | 7.87 | 3.16 | 5.38 | 7.62 | 24.03 |
| 1.8 | 7.87 | 3.10 | 5.28 | 7.62 | 23.87 |
| 1.9 | 7.87 | 3.05 | 5.18 | 7.62 | 23.72 |
| 2.0 | 7.87 | 3.00 | 5.08 | 7.62 | 23.58 |
| 2.1 | 7.87 | 2.95 | 4.99 | 7.62 | 23.43 |
| 2.2 | 7.87 | 2.90 | 4.89 | 7.62 | 23.29 |
| 2.3 | 7.87 | 2.86 | 4.81 | 7.62 | 23.15 |
| 2.4 | 7.87 | 2.81 | 4.72 | 7.62 | 23.02 |
| 2.5 | 7.87 | 2.76 | 4.63 | 7.62 | 22.89 |
| 2.6 | 7.87 | 2.72 | 4.55 | 7.62 | 22.76 |
| 2.7 | 7.87 | 2.67 | 4.47 | 7.62 | 22.63 |
| 2.8 | 7.87 | 2.63 | 4.39 | 7.62 | 22.51 |
| 2.9 | 7.87 | 2.58 | 4.31 | 7.62 | 22.39 |
| 3.0 | 7.87 | 2.54 | 4.23 | 7.62 | 22.27 |
| 3.1 | 7.87 | 7.87 | 4.16 | 7.45 | 27.36 |
| 3.2 | 7.87 | 7.87 | 4.09 | 7.29 | 27.12 |
| 3.3 | 7.87 | 7.87 | 4.02 | 7.14 | 26.90 |
| 3.4 | 7.87 | 7.87 | 3.95 | 6.99 | 26.68 |
| 3.5 | 7.87 | 7.87 | 3.88 | 6.84 | 26.46 |
| 3.6 | 7.87 | 7.87 | 3.81 | 6.70 | 26.25 |
| 3.7 | 7.87 | 7.87 | 3.74 | 6.56 | 26.05 |
| 3.8 | 7.87 | 7.87 | 3.68 | 6.43 | 25.85 |
| 3.9 | 7.87 | 7.87 | 3.62 | 6.30 | 25.66 |
| 4.0 | 7.87 | 7.87 | 3.56 | 6.17 | 25.47 |
| 4.1 | 7.87 | 7.87 | 3.50 | 6.05 | 25.29 |
| 4.2 | 7.87 | 7.87 | 3.44 | 5.93 | 25.11 |
| 4.3 | 7.87 | 7.87 | 3.38 | 5.81 | 24.93 |
| 4.4 | 7.87 | 7.87 | 3.32 | 5.70 | 24.76 |
| 4.5 | 7.87 | 7.87 | 3.27 | 5.59 | 24.60 |
| 4.6 | 7.87 | 7.87 | 3.21 | 5.48 | 24.44 |
| 4.7 | 7.87 | 7.87 | 3.16 | 5.38 | 24.28 |
| 4.8 | 7.87 | 7.87 | 3.10 | 5.28 | 24.12 |
| 4.9 | 7.87 | 7.87 | 3.05 | 5.18 | 23.97 |
| 5.0 | 7.87 | 7.87 | 3.00 | 5.08 | 23.83 |
| 5.1 | 7.87 | 7.87 | 2.95 | 4.99 | 23.68 |
| 5.2 | 7.87 | 7.87 | 2.90 | 4.89 | 23.54 |
| 5.3 | 7.87 | 7.87 | 2.86 | 4.81 | 23.40 |
| 5.4 | 7.87 | 7.87 | 2.81 | 4.72 | 23.27 |
| 5.5 | 7.87 | 7.87 | 2.76 | 4.63 | 23.14 |
| 5.6 | 7.87 | 7.87 | 2.72 | 4.55 | 23.01 |
| 5.7 | 7.87 | 7.87 | 2.67 | 4.47 | 22.88 |
| 5.8 | 7.87 | 7.87 | 2.63 | 4.39 | 22.76 |
| 5.9 | 7.87 | 7.87 | 2.58 | 4.31 | 22.64 |
| 6.0 | 7.87 | 7.87 | 2.54 | 4.23 | 22.52 |
| 6.1 | 7.70 | 7.87 | 7.87 | 4.16 | 27.60 |
| 6.2 | 7.53 | 7.87 | 7.87 | 4.09 | 27.36 |
| 6.3 | 7.37 | 7.87 | 7.87 | 4.02 | 27.13 |
| 6.4 | 7.22 | 7.87 | 7.87 | 3.95 | 26.91 |
| 6.5 | 7.06 | 7.87 | 7.87 | 3.88 | 26.69 |
| 6.6 | 6.92 | 7.87 | 7.87 | 3.81 | 26.47 |
| 6.7 | 6.78 | 7.87 | 7.87 | 3.74 | 26.26 |
| 6.8 | 6.64 | 7.87 | 7.87 | 3.68 | 26.06 |
| 6.9 | 6.50 | 7.87 | 7.87 | 3.62 | 25.86 |
| 7.0 | 6.37 | 7.87 | 7.87 | 3.56 | 25.67 |
| 7.1 | 6.25 | 7.87 | 7.87 | 3.50 | 25.49 |
| 7.2 | 6.12 | 7.87 | 7.87 | 3.44 | 25.30 |
| 7.3 | 6.00 | 7.87 | 7.87 | 3.38 | 25.13 |
| 7.4 | 5.89 | 7.87 | 7.87 | 3.32 | 24.95 |
| 7.5 | 5.77 | 7.87 | 7.87 | 3.27 | 24.78 |
| 7.6 | 5.66 | 7.87 | 7.87 | 3.21 | 24.62 |
| 7.7 | 5.55 | 7.87 | 7.87 | 3.16 | 24.46 |
| 7.8 | 5.45 | 7.87 | 7.87 | 3.10 | 24.30 |
| 7.9 | 5.35 | 7.87 | 7.87 | 3.05 | 24.14 |
| 8.0 | 5.25 | 7.87 | 7.87 | 3.00 | 23.99 |
| 8.1 | 5.15 | 7.87 | 7.87 | 2.95 | 23.85 |
| 8.2 | 5.06 | 7.87 | 7.87 | 2.90 | 23.70 |
| 8.3 | 4.96 | 7.87 | 7.87 | 2.86 | 23.56 |
| 8.4 | 4.87 | 7.87 | 7.87 | 2.81 | 23.42 |
| 8.5 | 4.78 | 7.87 | 7.87 | 2.76 | 23.29 |
| 8.6 | 4.70 | 7.87 | 7.87 | 2.72 | 23.16 |
| 8.7 | 4.61 | 7.87 | 7.87 | 2.67 | 23.03 |
| 8.8 | 4.53 | 7.87 | 7.87 | 2.63 | 22.90 |
| 8.9 | 4.45 | 7.87 | 7.87 | 2.58 | 22.78 |
| 9.0 | 4.37 | 7.87 | 7.87 | 2.54 | 22.66 |
| 9.1 | 4.30 | 7.70 | 7.87 | 7.87 | 27.74 |
| 9.2 | 4.22 | 7.53 | 7.87 | 7.87 | 27.50 |
| 9.3 | 4.15 | 7.37 | 7.87 | 7.87 | 27.26 |
| 9.4 | 4.08 | 7.22 | 7.87 | 7.87 | 27.04 |
| 9.5 | 4.00 | 7.06 | 7.87 | 7.87 | 26.81 |
| 9.6 | 3.94 | 6.92 | 7.87 | 7.87 | 26.60 |
| 9.7 | 3.87 | 6.78 | 7.87 | 7.87 | 26.39 |
| 9.8 | 3.80 | 6.64 | 7.87 | 7.87 | 26.18 |
| 9.9 | 3.74 | 6.50 | 7.87 | 7.87 | 25.98 |
| 10.0 | 3.67 | 6.37 | 7.87 | 7.87 | 25.79 |
| 10.1 | 3.61 | 6.25 | 7.87 | 7.87 | 25.60 |
| 10.2 | 3.55 | 6.12 | 7.87 | 7.87 | 25.42 |
| 10.3 | 3.49 | 6.00 | 7.87 | 7.87 | 25.24 |
| 10.4 | 3.43 | 5.89 | 7.87 | 7.87 | 25.06 |
| 10.5 | 3.37 | 5.77 | 7.87 | 7.87 | 24.89 |
| 10.6 | 3.32 | 5.66 | 7.87 | 7.87 | 24.72 |
| 10.7 | 3.26 | 5.55 | 7.87 | 7.87 | 24.56 |
| 10.8 | 3.21 | 5.45 | 7.87 | 7.87 | 24.40 |
| 10.9 | 3.15 | 5.35 | 7.87 | 7.87 | 24.24 |
| 11.0 | 3.10 | 5.25 | 7.87 | 7.87 | 24.09 |
| 11.1 | 3.05 | 5.15 | 7.87 | 7.87 | 23.94 |
| 11.2 | 3.00 | 5.06 | 7.87 | 7.87 | 23.80 |
| 11.3 | 2.95 | 4.96 | 7.87 | 7.87 | 23.66 |
| 11.4 | 2.90 | 4.87 | 7.87 | 7.87 | 23.52 |
| 11.5 | 2.85 | 4.78 | 7.87 | 7.87 | 23.38 |
| 11.6 | 2.80 | 4.70 | 7.87 | 7.87 | 23.25 |
| 11.7 | 2.76 | 4.61 | 7.87 | 7.87 | 23.12 |
| 11.8 | 2.71 | 4.53 | 7.87 | 7.87 | 22.99 |
| 11.9 | 2.67 | 4.45 | 7.87 | 7.87 | 22.86 |
| 12.0 | 2.62 | 4.37 | 7.87 | 7.87 | 22.74 |

FIG. 53

| | | | |
|---|---|---|---|
| High Side Pressure | | 300 | psi (absolute) |
| Low Side Pressure | | 75 | psi (absolute) |
| Cylinder Diameter | | 3.500 | in |
| Rod Diameter | | 0.625 | in |
| Sprocket Root Diameter | | 4.50 | in |
| Cylinder Stroke Length | | 12.00 | in |
| Time to complete 1 cycle (extend and retract) | | 1.00 | seconds |
| Extending | Stroke length when inlet valve closes | 6.0 | in |
| | Calculated Ending Pressure | 150.0 | psi (absolute) |
| | Maximum Horsepower | 7.87 | hp |
| | Average Horsepower | 6.25 | hp |
| Retracting | Stroke length when inlet valve closes | 6.0 | in |
| | Calculated Ending Pressure | 150.0 | psi (absolute) |
| | Maximum Horsepower | 7.62 | hp |
| | Average Horsepower | 6.05 | hp |

FIG. 54

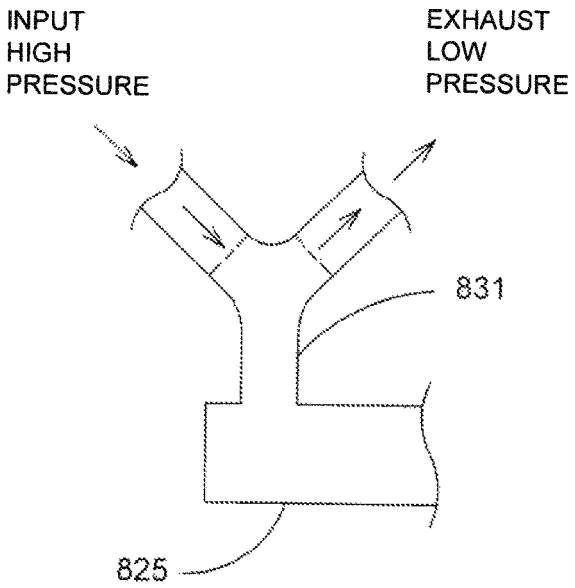

FIG. 55

Extending

| Distance inch | Volume in^3 | Pressure psi | Force lbs | Output Torque in-lbs | Inlet Valve Open | P1*V1 | Pressure | Output Horsepower |
|---|---|---|---|---|---|---|---|---|
| 0 | 0.00 | 300.00 | 2164.75 | 4870.70 | x | 0.00 | 300.00 | 7.87 |
| 0.1 | 0.96 | 300.00 | 2164.75 | 4870.70 | x | 288.63 | 300.00 | 7.87 |
| 0.2 | 1.92 | 300.00 | 2164.75 | 4870.70 | x | 577.27 | 300.00 | 7.87 |
| 0.3 | 2.89 | 300.00 | 2164.75 | 4870.70 | x | 865.90 | 300.00 | 7.87 |
| 0.4 | 3.85 | 300.00 | 2164.75 | 4870.70 | x | 1154.54 | 300.00 | 7.87 |
| 0.5 | 4.81 | 300.00 | 2164.75 | 4870.70 | x | 1443.17 | 300.00 | 7.87 |
| 0.6 | 5.77 | 300.00 | 2164.75 | 4870.70 | x | 1731.80 | 300.00 | 7.87 |
| 0.7 | 6.73 | 300.00 | 2164.75 | 4870.70 | x | 2020.44 | 300.00 | 7.87 |
| 0.8 | 7.70 | 300.00 | 2164.75 | 4870.70 | x | 2309.07 | 300.00 | 7.87 |
| 0.9 | 8.66 | 300.00 | 2164.75 | 4870.70 | x | 2597.70 | 300.00 | 7.87 |
| 1 | 9.62 | 300.00 | 2164.75 | 4870.70 | x | 2886.34 | 300.00 | 7.87 |
| 1.1 | 10.58 | 300.00 | 2164.75 | 4870.70 | x | 3174.97 | 300.00 | 7.87 |
| 1.2 | 11.55 | 300.00 | 2164.75 | 4870.70 | x | 3463.61 | 300.00 | 7.87 |
| 1.3 | 12.51 | 300.00 | 2164.75 | 4870.70 | x | 3752.24 | 300.00 | 7.87 |
| 1.4 | 13.47 | 300.00 | 2164.75 | 4870.70 | x | 4040.87 | 300.00 | 7.87 |
| 1.5 | 14.43 | 300.00 | 2164.75 | 4870.70 | x | 4329.51 | 300.00 | 7.87 |
| 1.6 | 15.39 | 300.00 | 2164.75 | 4870.70 | x | 4618.14 | 300.00 | 7.87 |
| 1.7 | 16.36 | 300.00 | 2164.75 | 4870.70 | x | 4906.78 | 300.00 | 7.87 |
| 1.8 | 17.32 | 300.00 | 2164.75 | 4870.70 | x | 5195.41 | 300.00 | 7.87 |
| 1.9 | 18.28 | 300.00 | 2164.75 | 4870.70 | x | 5484.04 | 300.00 | 7.87 |
| 2 | 19.24 | 300.00 | 2164.75 | 4870.70 | x | 5772.68 | 300.00 | 7.87 |
| 2.1 | 20.20 | 300.00 | 2164.75 | 4870.70 | x | 6061.31 | 300.00 | 7.87 |
| 2.2 | 21.17 | 300.00 | 2164.75 | 4870.70 | x | 6349.94 | 300.00 | 7.87 |
| 2.3 | 22.13 | 300.00 | 2164.75 | 4870.70 | x | 6638.58 | 300.00 | 7.87 |
| 2.4 | 23.09 | 300.00 | 2164.75 | 4870.70 | x | 6927.21 | 300.00 | 7.87 |
| 2.5 | 24.05 | 300.00 | 2164.75 | 4870.70 | x | 7215.85 | 300.00 | 7.87 |
| 2.6 | 25.01 | 300.00 | 2164.75 | 4870.70 | x | 7504.48 | 300.00 | 7.87 |
| 2.7 | 25.98 | 300.00 | 2164.75 | 4870.70 | x | 7793.11 | 300.00 | 7.87 |
| 2.8 | 26.94 | 300.00 | 2164.75 | 4870.70 | x | 8081.75 | 300.00 | 7.87 |
| 2.9 | 27.90 | 300.00 | 2164.75 | 4870.70 | x | 8370.38 | 300.00 | 7.87 |
| 3 | 28.86 | 300.00 | 2164.75 | 4870.70 | x | 8659.01 | 300.00 | 7.87 |
| 3.1 | 29.83 | 290.32 | 2071.65 | 4661.20 | | 8659.01 | 290.32 | 7.53 |
| 3.2 | 30.79 | 281.25 | 1984.36 | 4464.80 | | 8659.01 | 281.25 | 7.22 |
| 3.3 | 31.75 | 272.73 | 1902.36 | 4280.31 | | 8659.01 | 272.73 | 6.92 |
| 3.4 | 32.71 | 264.71 | 1825.18 | 4106.67 | | 8659.01 | 264.71 | 6.64 |
| 3.5 | 33.67 | 257.14 | 1752.42 | 3942.94 | | 8659.01 | 257.14 | 6.37 |
| 3.6 | 34.64 | 250.00 | 1683.70 | 3788.32 | | 8659.01 | 250.00 | 6.12 |
| 3.7 | 35.60 | 243.24 | 1618.69 | 3642.05 | | 8659.01 | 243.24 | 5.89 |
| 3.8 | 36.56 | 236.84 | 1557.10 | 3503.48 | | 8659.01 | 236.84 | 5.66 |
| 3.9 | 37.52 | 230.77 | 1498.68 | 3372.02 | | 8659.01 | 230.77 | 5.45 |
| 4 | 38.48 | 225.00 | 1443.17 | 3247.13 | | 8659.01 | 225.00 | 5.25 |
| 4.1 | 39.45 | 219.51 | 1390.37 | 3128.33 | | 8659.01 | 219.51 | 5.06 |
| 4.2 | 40.41 | 214.29 | 1340.09 | 3015.19 | | 8659.01 | 214.29 | 4.87 |
| 4.3 | 41.37 | 209.30 | 1292.14 | 2907.31 | | 8659.01 | 209.30 | 4.70 |
| 4.4 | 42.33 | 204.55 | 1246.37 | 2804.34 | | 8659.01 | 204.55 | 4.53 |
| 4.5 | 43.30 | 200.00 | 1202.64 | 2705.94 | | 8659.01 | 200.00 | 4.37 |
| 4.6 | 44.26 | 195.65 | 1160.81 | 2611.82 | | 8659.01 | 195.65 | 4.22 |
| 4.7 | 45.22 | 191.49 | 1120.76 | 2521.71 | | 8659.01 | 191.49 | 4.08 |
| 4.8 | 46.18 | 187.50 | 1082.38 | 2435.35 | | 8659.01 | 187.50 | 3.94 |
| 4.9 | 47.14 | 183.67 | 1045.56 | 2352.51 | | 8659.01 | 183.67 | 3.80 |
| 5 | 48.11 | 180.00 | 1010.22 | 2272.99 | | 8659.01 | 180.00 | 3.67 |
| 5.1 | 49.07 | 176.47 | 976.26 | 2196.59 | | 8659.01 | 176.47 | 3.55 |
| 5.2 | 50.03 | 173.08 | 943.61 | 2123.12 | | 8659.01 | 173.08 | 3.43 |
| 5.3 | 50.99 | 169.81 | 912.19 | 2052.43 | | 8659.01 | 169.81 | 3.32 |
| 5.4 | 51.95 | 166.67 | 881.94 | 1984.36 | | 8659.01 | 166.67 | 3.21 |
| 5.5 | 52.92 | 163.64 | 852.78 | 1918.76 | | 8659.01 | 163.64 | 3.10 |
| 5.6 | 53.88 | 160.71 | 824.67 | 1855.50 | | 8659.01 | 160.71 | 3.00 |
| 5.7 | 54.84 | 157.89 | 797.54 | 1794.47 | | 8659.01 | 157.89 | 2.90 |
| 5.8 | 55.80 | 155.17 | 771.35 | 1735.54 | | 8659.01 | 155.17 | 2.80 |

FIG. 57A

| Distance inch | Volume in^3 | Pressure psi | Force lbs | Output Torque in-lbs | Inlet Valve Open | P1*V1 | Pressure | Output Horsepower |
|---|---|---|---|---|---|---|---|---|
| 5.9 | 56.76 | 152.54 | 746.05 | 1678.60 | | 8659.01 | 152.54 | 2.71 |
| 6 | 57.73 | 150.00 | 721.58 | 1623.57 | | 8659.01 | 150.00 | 2.62 |
| 6.1 | 58.69 | 147.54 | 697.93 | 1570.33 | | 8659.01 | 147.54 | 2.54 |
| 6.2 | 59.65 | 145.16 | 675.03 | 1518.82 | | 8659.01 | 145.16 | 2.45 |
| 6.3 | 60.61 | 142.86 | 652.86 | 1468.94 | | 8659.01 | 142.86 | 2.37 |
| 6.4 | 61.58 | 140.63 | 631.39 | 1420.62 | | 8659.01 | 140.63 | 2.30 |
| 6.5 | 62.54 | 138.46 | 610.57 | 1373.79 | | 8659.01 | 138.46 | 2.22 |
| 6.6 | 63.50 | 136.36 | 590.39 | 1328.37 | | 8659.01 | 136.36 | 2.15 |
| 6.7 | 64.46 | 134.33 | 570.81 | 1284.31 | | 8659.01 | 134.33 | 2.08 |
| 6.8 | 65.42 | 132.35 | 551.80 | 1241.55 | | 8659.01 | 132.35 | 2.01 |
| 6.9 | 66.39 | 130.43 | 533.35 | 1200.03 | | 8659.01 | 130.43 | 1.94 |
| 7 | 67.35 | 128.57 | 515.42 | 1159.69 | | 8659.01 | 128.57 | 1.87 |
| 7.1 | 68.31 | 126.76 | 497.99 | 1120.49 | | 8659.01 | 126.76 | 1.81 |
| 7.2 | 69.27 | 125.00 | 481.06 | 1082.38 | | 8659.01 | 125.00 | 1.75 |
| 7.3 | 70.23 | 123.29 | 464.58 | 1045.31 | | 8659.01 | 123.29 | 1.69 |
| 7.4 | 71.20 | 121.62 | 448.55 | 1009.24 | | 8659.01 | 121.62 | 1.63 |
| 7.5 | 72.16 | 120.00 | 432.95 | 974.14 | | 8659.01 | 120.00 | 1.57 |
| 7.6 | 73.12 | 118.42 | 417.76 | 939.96 | | 8659.01 | 118.42 | 1.52 |
| 7.7 | 74.08 | 116.88 | 402.96 | 906.67 | | 8659.01 | 116.88 | 1.47 |
| 7.8 | 75.04 | 115.38 | 388.55 | 874.23 | | 8659.01 | 115.38 | 1.41 |
| 7.9 | 76.01 | 113.92 | 374.49 | 842.61 | | 8659.01 | 113.92 | 1.36 |
| 8 | 76.97 | 112.50 | 360.79 | 811.78 | | 8659.01 | 112.50 | 1.31 |
| 8.1 | 77.93 | 111.11 | 347.43 | 781.72 | | 8659.01 | 111.11 | 1.26 |
| 8.2 | 78.89 | 109.76 | 334.39 | 752.38 | | 8659.01 | 109.76 | 1.22 |
| 8.3 | 79.86 | 108.43 | 321.67 | 723.76 | | 8659.01 | 108.43 | 1.17 |
| 8.4 | 80.82 | 107.14 | 309.25 | 695.81 | | 8659.01 | 107.14 | 1.12 |
| 8.5 | 81.78 | 105.88 | 297.12 | 668.53 | | 8659.01 | 105.88 | 1.08 |
| 8.6 | 82.74 | 104.65 | 285.28 | 641.87 | | 8659.01 | 104.65 | 1.04 |
| 8.7 | 83.70 | 103.45 | 273.70 | 615.84 | | 8659.01 | 103.45 | 1.00 |
| 8.8 | 84.67 | 102.27 | 262.39 | 590.39 | | 8659.01 | 102.27 | 0.95 |
| 8.9 | 85.63 | 101.12 | 251.34 | 565.51 | | 8659.01 | 101.12 | 0.91 |
| 9 | 86.59 | 100.00 | 240.53 | 541.19 | | 8659.01 | 100.00 | 0.87 |
| 9.1 | 87.55 | 98.90 | 229.96 | 517.40 | | 8659.01 | 98.90 | 0.84 |
| 9.2 | 88.51 | 97.83 | 219.61 | 494.13 | | 8659.01 | 97.83 | 0.80 |
| 9.3 | 89.48 | 96.77 | 209.49 | 471.36 | | 8659.01 | 96.77 | 0.76 |
| 9.4 | 90.44 | 95.74 | 199.59 | 449.07 | | 8659.01 | 95.74 | 0.73 |
| 9.5 | 91.40 | 94.74 | 189.89 | 427.25 | | 8659.01 | 94.74 | 0.69 |
| 9.6 | 92.36 | 93.75 | 180.40 | 405.89 | | 8659.01 | 93.75 | 0.66 |
| 9.7 | 93.32 | 92.78 | 171.10 | 384.97 | | 8659.01 | 92.78 | 0.62 |
| 9.8 | 94.29 | 91.84 | 161.99 | 364.47 | | 8659.01 | 91.84 | 0.59 |
| 9.9 | 95.25 | 90.91 | 153.06 | 344.39 | | 8659.01 | 90.91 | 0.56 |
| 10 | 96.21 | 90.00 | 144.32 | 324.71 | | 8659.01 | 90.00 | 0.52 |
| 10.1 | 97.17 | 89.11 | 135.74 | 305.42 | | 8659.01 | 89.11 | 0.49 |
| 10.2 | 98.14 | 88.24 | 127.34 | 286.51 | | 8659.01 | 88.24 | 0.46 |
| 10.3 | 99.10 | 87.38 | 119.10 | 267.97 | | 8659.01 | 87.38 | 0.43 |
| 10.4 | 100.06 | 86.54 | 111.01 | 249.78 | | 8659.01 | 86.54 | 0.40 |
| 10.5 | 101.02 | 85.71 | 103.08 | 231.94 | | 8659.01 | 85.71 | 0.37 |
| 10.6 | 101.98 | 84.91 | 95.30 | 214.43 | | 8659.01 | 84.91 | 0.35 |
| 10.7 | 102.95 | 84.11 | 87.67 | 197.26 | | 8659.01 | 84.11 | 0.32 |
| 10.8 | 103.91 | 83.33 | 80.18 | 180.40 | | 8659.01 | 83.33 | 0.29 |
| 10.9 | 104.87 | 82.57 | 72.82 | 163.85 | | 8659.01 | 82.57 | 0.26 |
| 11 | 105.83 | 81.82 | 65.60 | 147.60 | | 8659.01 | 81.82 | 0.24 |
| 11.1 | 106.79 | 81.08 | 58.51 | 131.64 | | 8659.01 | 81.08 | 0.21 |
| 11.2 | 107.76 | 80.36 | 51.54 | 115.97 | | 8659.01 | 80.36 | 0.19 |
| 11.3 | 108.72 | 79.65 | 44.70 | 100.57 | | 8659.01 | 79.65 | 0.16 |
| 11.4 | 109.68 | 78.95 | 37.98 | 85.45 | | 8659.01 | 78.95 | 0.14 |
| 11.5 | 110.64 | 78.26 | 31.37 | 70.59 | | 8659.01 | 78.26 | 0.11 |
| 11.6 | 111.61 | 77.59 | 24.88 | 55.99 | | 8659.01 | 77.59 | 0.09 |
| 11.7 | 112.57 | 76.92 | 18.50 | 41.63 | | 8659.01 | 76.92 | 0.07 |
| 11.8 | 113.53 | 76.27 | 12.23 | 27.52 | | 8659.01 | 76.27 | 0.04 |
| 11.9 | 114.49 | 75.63 | 6.06 | 13.64 | | 8659.01 | 75.63 | 0.02 |
| 12 | 115.45 | 75.00 | 0.00 | 0.00 | | 8659.01 | 75.00 | 0.00 |

FIG. 57B

Retracting

| Distance inch | Volume in^3 | Pressure psi | Force lbs | Output Torque in-lbs | Inlet Valve Open | P1*V1 | Pressure | Output Horsepower |
|---|---|---|---|---|---|---|---|---|
| 12 | 0.00 | 300.00 | 2095.72 | 4715.38 | x | 0.00 | 300.00 | 7.62 |
| 11.9 | 0.93 | 300.00 | 2095.72 | 4715.38 | x | 279.43 | 300.00 | 7.62 |
| 11.8 | 1.86 | 300.00 | 2095.72 | 4715.38 | x | 558.86 | 300.00 | 7.62 |
| 11.7 | 2.79 | 300.00 | 2095.72 | 4715.38 | x | 838.29 | 300.00 | 7.62 |
| 11.6 | 3.73 | 300.00 | 2095.72 | 4715.38 | x | 1117.72 | 300.00 | 7.62 |
| 11.5 | 4.66 | 300.00 | 2095.72 | 4715.38 | x | 1397.15 | 300.00 | 7.62 |
| 11.4 | 5.59 | 300.00 | 2095.72 | 4715.38 | x | 1676.58 | 300.00 | 7.62 |
| 11.3 | 6.52 | 300.00 | 2095.72 | 4715.38 | x | 1956.01 | 300.00 | 7.62 |
| 11.2 | 7.45 | 300.00 | 2095.72 | 4715.38 | x | 2235.44 | 300.00 | 7.62 |
| 11.1 | 8.38 | 300.00 | 2095.72 | 4715.38 | x | 2514.87 | 300.00 | 7.62 |
| 11 | 9.31 | 300.00 | 2095.72 | 4715.38 | x | 2794.30 | 300.00 | 7.62 |
| 10.9 | 10.25 | 300.00 | 2095.72 | 4715.38 | x | 3073.73 | 300.00 | 7.62 |
| 10.8 | 11.18 | 300.00 | 2095.72 | 4715.38 | x | 3353.16 | 300.00 | 7.62 |
| 10.7 | 12.11 | 300.00 | 2095.72 | 4715.38 | x | 3632.59 | 300.00 | 7.62 |
| 10.6 | 13.04 | 300.00 | 2095.72 | 4715.38 | x | 3912.02 | 300.00 | 7.62 |
| 10.5 | 13.97 | 300.00 | 2095.72 | 4715.38 | x | 4191.45 | 300.00 | 7.62 |
| 10.4 | 14.90 | 300.00 | 2095.72 | 4715.38 | x | 4470.88 | 300.00 | 7.62 |
| 10.3 | 15.83 | 300.00 | 2095.72 | 4715.38 | x | 4750.31 | 300.00 | 7.62 |
| 10.2 | 16.77 | 300.00 | 2095.72 | 4715.38 | x | 5029.74 | 300.00 | 7.62 |
| 10.1 | 17.70 | 300.00 | 2095.72 | 4715.38 | x | 5309.17 | 300.00 | 7.62 |
| 10 | 18.63 | 300.00 | 2095.72 | 4715.38 | x | 5588.60 | 300.00 | 7.62 |
| 9.9 | 19.56 | 300.00 | 2095.72 | 4715.38 | x | 5868.03 | 300.00 | 7.62 |
| 9.8 | 20.49 | 300.00 | 2095.72 | 4715.38 | x | 6147.46 | 300.00 | 7.62 |
| 9.7 | 21.42 | 300.00 | 2095.72 | 4715.38 | x | 6426.89 | 300.00 | 7.62 |
| 9.6 | 22.35 | 300.00 | 2095.72 | 4715.38 | x | 6706.32 | 300.00 | 7.62 |
| 9.5 | 23.29 | 300.00 | 2095.72 | 4715.38 | x | 6985.75 | 300.00 | 7.62 |
| 9.4 | 24.22 | 300.00 | 2095.72 | 4715.38 | x | 7265.18 | 300.00 | 7.62 |
| 9.3 | 25.15 | 300.00 | 2095.72 | 4715.38 | x | 7544.61 | 300.00 | 7.62 |
| 9.2 | 26.08 | 300.00 | 2095.72 | 4715.38 | x | 7824.04 | 300.00 | 7.62 |
| 9.1 | 27.01 | 300.00 | 2095.72 | 4715.38 | x | 8103.47 | 300.00 | 7.62 |
| 9 | 27.94 | 300.00 | 2095.72 | 4715.38 | x | 8382.90 | 300.00 | 7.62 |
| 8.9 | 28.87 | 290.32 | 2005.59 | 4512.57 | | 8382.90 | 290.32 | 7.29 |
| 8.8 | 29.81 | 281.25 | 1921.08 | 4322.43 | | 8382.90 | 281.25 | 6.99 |
| 8.7 | 30.74 | 272.73 | 1841.70 | 4143.82 | | 8382.90 | 272.73 | 6.70 |
| 8.6 | 31.67 | 264.71 | 1766.98 | 3975.71 | | 8382.90 | 264.71 | 6.43 |
| 8.5 | 32.60 | 257.14 | 1696.54 | 3817.21 | | 8382.90 | 257.14 | 6.17 |
| 8.4 | 33.53 | 250.00 | 1630.01 | 3667.52 | | 8382.90 | 250.00 | 5.93 |
| 8.3 | 34.46 | 243.24 | 1567.07 | 3525.91 | | 8382.90 | 243.24 | 5.70 |
| 8.2 | 35.39 | 236.84 | 1507.45 | 3391.76 | | 8382.90 | 236.84 | 5.48 |
| 8.1 | 36.33 | 230.77 | 1450.89 | 3264.49 | | 8382.90 | 230.77 | 5.28 |
| 8 | 37.26 | 225.00 | 1397.15 | 3143.59 | | 8382.90 | 225.00 | 5.08 |
| 7.9 | 38.19 | 219.51 | 1346.03 | 3028.58 | | 8382.90 | 219.51 | 4.89 |
| 7.8 | 39.12 | 214.29 | 1297.35 | 2919.04 | | 8382.90 | 214.29 | 4.72 |
| 7.7 | 40.05 | 209.30 | 1250.94 | 2814.61 | | 8382.90 | 209.30 | 4.55 |
| 7.6 | 40.98 | 204.55 | 1206.63 | 2714.92 | | 8382.90 | 204.55 | 4.39 |
| 7.5 | 41.91 | 200.00 | 1164.29 | 2619.66 | | 8382.90 | 200.00 | 4.23 |
| 7.4 | 42.85 | 195.65 | 1123.79 | 2528.54 | | 8382.90 | 195.65 | 4.09 |
| 7.3 | 43.78 | 191.49 | 1085.02 | 2441.30 | | 8382.90 | 191.49 | 3.95 |
| 7.2 | 44.71 | 187.50 | 1047.86 | 2357.69 | | 8382.90 | 187.50 | 3.81 |
| 7.1 | 45.64 | 183.67 | 1012.22 | 2277.50 | | 8382.90 | 183.67 | 3.68 |
| 7 | 46.57 | 180.00 | 978.00 | 2200.51 | | 8382.90 | 180.00 | 3.56 |
| 6.9 | 47.50 | 176.47 | 945.13 | 2126.54 | | 8382.90 | 176.47 | 3.44 |
| 6.8 | 48.43 | 173.08 | 913.52 | 2055.42 | | 8382.90 | 173.08 | 3.32 |
| 6.7 | 49.37 | 169.81 | 883.10 | 1986.98 | | 8382.90 | 169.81 | 3.21 |
| 6.6 | 50.30 | 166.67 | 853.81 | 1921.08 | | 8382.90 | 166.67 | 3.10 |
| 6.5 | 51.23 | 163.64 | 825.59 | 1857.57 | | 8382.90 | 163.64 | 3.00 |
| 6.4 | 52.16 | 160.71 | 798.37 | 1796.34 | | 8382.90 | 160.71 | 2.90 |
| 6.3 | 53.09 | 157.89 | 772.11 | 1737.25 | | 8382.90 | 157.89 | 2.81 |
| 6.2 | 54.02 | 155.17 | 746.75 | 1680.19 | | 8382.90 | 155.17 | 2.72 |
| 6.1 | 54.95 | 152.54 | 722.26 | 1625.07 | | 8382.90 | 152.54 | 2.63 |

FIG. 58A

| Distance inch | Volume in^3 | Pressure psi | Force lbs | Output Torque in-lbs | Inlet Valve Open | P1*V1 | Pressure | Output Horsepower |
|---|---|---|---|---|---|---|---|---|
| 6 | 55.89 | 150.00 | 698.57 | 1571.79 | | 8382.90 | 150.00 | 2.54 |
| 5.9 | 56.82 | 147.54 | 675.67 | 1520.26 | | 8382.90 | 147.54 | 2.46 |
| 5.8 | 57.75 | 145.16 | 653.51 | 1470.39 | | 8382.90 | 145.16 | 2.38 |
| 5.7 | 58.68 | 142.86 | 632.04 | 1422.10 | | 8382.90 | 142.86 | 2.30 |
| 5.6 | 59.61 | 140.63 | 611.25 | 1375.32 | | 8382.90 | 140.63 | 2.22 |
| 5.5 | 60.54 | 138.46 | 591.10 | 1329.98 | | 8382.90 | 138.46 | 2.15 |
| 5.4 | 61.47 | 136.36 | 571.56 | 1286.01 | | 8382.90 | 136.36 | 2.08 |
| 5.3 | 62.41 | 134.33 | 552.60 | 1243.36 | | 8382.90 | 134.33 | 2.01 |
| 5.2 | 63.34 | 132.35 | 534.20 | 1201.96 | | 8382.90 | 132.35 | 1.94 |
| 5.1 | 64.27 | 130.43 | 516.34 | 1161.76 | | 8382.90 | 130.43 | 1.88 |
| 5 | 65.20 | 128.57 | 498.98 | 1122.71 | | 8382.90 | 128.57 | 1.81 |
| 4.9 | 66.13 | 126.76 | 482.12 | 1084.76 | | 8382.90 | 126.76 | 1.75 |
| 4.8 | 67.06 | 125.00 | 465.72 | 1047.86 | | 8382.90 | 125.00 | 1.69 |
| 4.7 | 67.99 | 123.29 | 449.77 | 1011.98 | | 8382.90 | 123.29 | 1.64 |
| 4.6 | 68.93 | 121.62 | 434.25 | 977.06 | | 8382.90 | 121.62 | 1.58 |
| 4.5 | 69.86 | 120.00 | 419.14 | 943.08 | | 8382.90 | 120.00 | 1.52 |
| 4.4 | 70.79 | 118.42 | 404.44 | 909.99 | | 8382.90 | 118.42 | 1.47 |
| 4.3 | 71.72 | 116.88 | 390.11 | 877.75 | | 8382.90 | 116.88 | 1.42 |
| 4.2 | 72.65 | 115.38 | 376.16 | 846.35 | | 8382.90 | 115.38 | 1.37 |
| 4.1 | 73.58 | 113.92 | 362.55 | 815.74 | | 8382.90 | 113.92 | 1.32 |
| 4 | 74.51 | 112.50 | 349.29 | 785.90 | | 8382.90 | 112.50 | 1.27 |
| 3.9 | 75.45 | 111.11 | 336.35 | 756.79 | | 8382.90 | 111.11 | 1.22 |
| 3.8 | 76.38 | 109.76 | 323.73 | 728.39 | | 8382.90 | 109.76 | 1.18 |
| 3.7 | 77.31 | 108.43 | 311.41 | 700.68 | | 8382.90 | 108.43 | 1.13 |
| 3.6 | 78.24 | 107.14 | 299.39 | 673.63 | | 8382.90 | 107.14 | 1.09 |
| 3.5 | 79.17 | 105.88 | 287.65 | 647.21 | | 8382.90 | 105.88 | 1.05 |
| 3.4 | 80.10 | 104.65 | 276.18 | 621.41 | | 8382.90 | 104.65 | 1.00 |
| 3.3 | 81.03 | 103.45 | 264.98 | 596.20 | | 8382.90 | 103.45 | 0.96 |
| 3.2 | 81.97 | 102.27 | 254.03 | 571.56 | | 8382.90 | 102.27 | 0.92 |
| 3.1 | 82.90 | 101.12 | 243.32 | 547.48 | | 8382.90 | 101.12 | 0.88 |
| 3 | 83.83 | 100.00 | 232.86 | 523.93 | | 8382.90 | 100.00 | 0.85 |
| 2.9 | 84.76 | 98.90 | 222.62 | 500.90 | | 8382.90 | 98.90 | 0.81 |
| 2.8 | 85.69 | 97.83 | 212.61 | 478.37 | | 8382.90 | 97.83 | 0.77 |
| 2.7 | 86.62 | 96.77 | 202.81 | 456.33 | | 8382.90 | 96.77 | 0.74 |
| 2.6 | 87.55 | 95.74 | 193.22 | 434.75 | | 8382.90 | 95.74 | 0.70 |
| 2.5 | 88.49 | 94.74 | 183.84 | 413.63 | | 8382.90 | 94.74 | 0.67 |
| 2.4 | 89.42 | 93.75 | 174.64 | 392.95 | | 8382.90 | 93.75 | 0.64 |
| 2.3 | 90.35 | 92.78 | 165.64 | 372.69 | | 8382.90 | 92.78 | 0.60 |
| 2.2 | 91.28 | 91.84 | 156.82 | 352.85 | | 8382.90 | 91.84 | 0.57 |
| 2.1 | 92.21 | 90.91 | 148.18 | 333.41 | | 8382.90 | 90.91 | 0.54 |
| 2 | 93.14 | 90.00 | 139.71 | 314.36 | | 8382.90 | 90.00 | 0.51 |
| 1.9 | 94.07 | 89.11 | 131.42 | 295.68 | | 8382.90 | 89.11 | 0.48 |
| 1.8 | 95.01 | 88.24 | 123.28 | 277.38 | | 8382.90 | 88.24 | 0.45 |
| 1.7 | 95.94 | 87.38 | 115.30 | 259.42 | | 8382.90 | 87.38 | 0.42 |
| 1.6 | 96.87 | 86.54 | 107.47 | 241.81 | | 8382.90 | 86.54 | 0.39 |
| 1.5 | 97.80 | 85.71 | 99.80 | 224.54 | | 8382.90 | 85.71 | 0.36 |
| 1.4 | 98.73 | 84.91 | 92.26 | 207.60 | | 8382.90 | 84.91 | 0.34 |
| 1.3 | 99.66 | 84.11 | 84.87 | 190.97 | | 8382.90 | 84.11 | 0.31 |
| 1.2 | 100.59 | 83.33 | 77.62 | 174.64 | | 8382.90 | 83.33 | 0.28 |
| 1.1 | 101.53 | 82.57 | 70.50 | 158.62 | | 8382.90 | 82.57 | 0.26 |
| 1 | 102.46 | 81.82 | 63.51 | 142.89 | | 8382.90 | 81.82 | 0.23 |
| 0.9 | 103.39 | 81.08 | 56.64 | 127.44 | | 8382.90 | 81.08 | 0.21 |
| 0.8 | 104.32 | 80.36 | 49.90 | 112.27 | | 8382.90 | 80.36 | 0.18 |
| 0.7 | 105.25 | 79.65 | 43.27 | 97.37 | | 8382.90 | 79.65 | 0.16 |
| 0.6 | 106.18 | 78.95 | 36.77 | 82.73 | | 8382.90 | 78.95 | 0.13 |
| 0.5 | 107.11 | 78.26 | 30.37 | 68.34 | | 8382.90 | 78.26 | 0.11 |
| 0.4 | 108.05 | 77.59 | 24.09 | 54.20 | | 8382.90 | 77.59 | 0.09 |
| 0.3 | 108.98 | 76.92 | 17.91 | 40.30 | | 8382.90 | 76.92 | 0.07 |
| 0.2 | 109.91 | 76.27 | 11.84 | 26.64 | | 8382.90 | 76.27 | 0.04 |
| 0.1 | 110.84 | 75.63 | 5.87 | 13.21 | | 8382.90 | 75.63 | 0.02 |
| 0 | 111.77 | 75.00 | 0.00 | 0.00 | | 8382.90 | 75.00 | 0.00 |

FIG. 58B

| Distance | power 1 | power 2 | power 3 | power 4 | Combined HP |
|---|---|---|---|---|---|
| 0 | 7.87 | 0.85 | 2.54 | 7.62 | 18.88 |
| 0.1 | 7.87 | 0.81 | 2.46 | 7.29 | 18.43 |
| 0.2 | 7.87 | 0.77 | 2.38 | 6.99 | 18.01 |
| 0.3 | 7.87 | 0.74 | 2.30 | 6.70 | 17.60 |
| 0.4 | 7.87 | 0.70 | 2.22 | 6.43 | 17.22 |
| 0.5 | 7.87 | 0.67 | 2.15 | 6.17 | 16.86 |
| 0.6 | 7.87 | 0.64 | 2.08 | 5.93 | 16.51 |
| 0.7 | 7.87 | 0.60 | 2.01 | 5.70 | 16.18 |
| 0.8 | 7.87 | 0.57 | 1.94 | 5.48 | 15.87 |
| 0.9 | 7.87 | 0.54 | 1.88 | 5.28 | 15.56 |
| 1 | 7.87 | 0.51 | 1.81 | 5.08 | 15.27 |
| 1.1 | 7.87 | 0.48 | 1.75 | 4.89 | 15.00 |
| 1.2 | 7.87 | 0.45 | 1.69 | 4.72 | 14.73 |
| 1.3 | 7.87 | 0.42 | 1.64 | 4.55 | 14.48 |
| 1.4 | 7.87 | 0.39 | 1.58 | 4.39 | 14.23 |
| 1.5 | 7.87 | 0.36 | 1.52 | 4.23 | 13.99 |
| 1.6 | 7.87 | 0.34 | 1.47 | 4.09 | 13.76 |
| 1.7 | 7.87 | 0.31 | 1.42 | 3.95 | 13.54 |
| 1.8 | 7.87 | 0.28 | 1.37 | 3.81 | 13.33 |
| 1.9 | 7.87 | 0.26 | 1.32 | 3.68 | 13.13 |
| 2 | 7.87 | 0.23 | 1.27 | 3.56 | 12.93 |
| 2.1 | 7.87 | 0.21 | 1.22 | 3.44 | 12.74 |
| 2.2 | 7.87 | 0.18 | 1.18 | 3.32 | 12.55 |
| 2.3 | 7.87 | 0.16 | 1.13 | 3.21 | 12.37 |
| 2.4 | 7.87 | 0.13 | 1.09 | 3.10 | 12.20 |
| 2.5 | 7.87 | 0.11 | 1.05 | 3.00 | 12.03 |
| 2.6 | 7.87 | 0.09 | 1.00 | 2.90 | 11.87 |
| 2.7 | 7.87 | 0.07 | 0.96 | 2.81 | 11.71 |
| 2.8 | 7.87 | 0.04 | 0.92 | 2.72 | 11.55 |
| 2.9 | 7.87 | 0.02 | 0.88 | 2.63 | 11.40 |
| 3 | 7.87 | 0.00 | 0.85 | 2.54 | 11.26 |
| 3.1 | 7.53 | 7.87 | 0.81 | 2.46 | 18.67 |
| 3.2 | 7.22 | 7.87 | 0.77 | 2.38 | 18.24 |
| 3.3 | 6.92 | 7.87 | 0.74 | 2.30 | 17.83 |
| 3.4 | 6.64 | 7.87 | 0.70 | 2.22 | 17.43 |
| 3.5 | 6.37 | 7.87 | 0.67 | 2.15 | 17.06 |
| 3.6 | 6.12 | 7.87 | 0.64 | 2.08 | 16.71 |
| 3.7 | 5.89 | 7.87 | 0.60 | 2.01 | 16.37 |
| 3.8 | 5.66 | 7.87 | 0.57 | 1.94 | 16.05 |
| 3.9 | 5.45 | 7.87 | 0.54 | 1.88 | 15.74 |
| 4 | 5.25 | 7.87 | 0.51 | 1.81 | 15.44 |
| 4.1 | 5.06 | 7.87 | 0.48 | 1.75 | 15.16 |
| 4.2 | 4.87 | 7.87 | 0.45 | 1.69 | 14.89 |
| 4.3 | 4.70 | 7.87 | 0.42 | 1.64 | 14.63 |
| 4.4 | 4.53 | 7.87 | 0.39 | 1.58 | 14.37 |
| 4.5 | 4.37 | 7.87 | 0.36 | 1.52 | 14.13 |
| 4.6 | 4.22 | 7.87 | 0.34 | 1.47 | 13.90 |
| 4.7 | 4.08 | 7.87 | 0.31 | 1.42 | 13.67 |
| 4.8 | 3.94 | 7.87 | 0.28 | 1.37 | 13.46 |
| 4.9 | 3.80 | 7.87 | 0.26 | 1.32 | 13.25 |
| 5 | 3.67 | 7.87 | 0.23 | 1.27 | 13.05 |
| 5.1 | 3.55 | 7.87 | 0.21 | 1.22 | 12.85 |
| 5.2 | 3.43 | 7.87 | 0.18 | 1.18 | 12.66 |
| 5.3 | 3.32 | 7.87 | 0.16 | 1.13 | 12.48 |
| 5.4 | 3.21 | 7.87 | 0.13 | 1.09 | 12.30 |
| 5.5 | 3.10 | 7.87 | 0.11 | 1.05 | 12.13 |
| 5.6 | 3.00 | 7.87 | 0.09 | 1.00 | 11.96 |
| 5.7 | 2.90 | 7.87 | 0.07 | 0.96 | 11.80 |
| 5.8 | 2.80 | 7.87 | 0.04 | 0.92 | 11.64 |
| 5.9 | 2.71 | 7.87 | 0.02 | 0.88 | 11.49 |
| 6 | 2.62 | 7.87 | 0.00 | 0.85 | 11.34 |
| 6.1 | 2.54 | 7.87 | 7.87 | 0.81 | 19.09 |
| 6.2 | 2.45 | 7.53 | 7.87 | 0.77 | 18.63 |
| 6.3 | 2.37 | 7.22 | 7.87 | 0.74 | 18.20 |
| 6.4 | 2.30 | 6.92 | 7.87 | 0.70 | 17.79 |
| 6.5 | 2.22 | 6.64 | 7.87 | 0.67 | 17.40 |
| 6.6 | 2.15 | 6.37 | 7.87 | 0.64 | 17.03 |
| 6.7 | 2.08 | 6.12 | 7.87 | 0.60 | 16.67 |
| 6.8 | 2.01 | 5.89 | 7.87 | 0.57 | 16.33 |
| 6.9 | 1.94 | 5.66 | 7.87 | 0.54 | 16.01 |
| 7 | 1.87 | 5.45 | 7.87 | 0.51 | 15.70 |
| 7.1 | 1.81 | 5.25 | 7.87 | 0.48 | 15.41 |
| 7.2 | 1.75 | 5.06 | 7.87 | 0.45 | 15.13 |
| 7.3 | 1.69 | 4.87 | 7.87 | 0.42 | 14.85 |
| 7.4 | 1.63 | 4.70 | 7.87 | 0.39 | 14.59 |
| 7.5 | 1.57 | 4.53 | 7.87 | 0.36 | 14.34 |
| 7.6 | 1.52 | 4.37 | 7.87 | 0.34 | 14.10 |
| 7.7 | 1.47 | 4.22 | 7.87 | 0.31 | 13.87 |
| 7.8 | 1.41 | 4.08 | 7.87 | 0.28 | 13.64 |
| 7.9 | 1.36 | 3.94 | 7.87 | 0.26 | 13.43 |
| 8 | 1.31 | 3.80 | 7.87 | 0.23 | 13.22 |
| 8.1 | 1.26 | 3.67 | 7.87 | 0.21 | 13.01 |
| 8.2 | 1.22 | 3.55 | 7.87 | 0.18 | 12.82 |
| 8.3 | 1.17 | 3.43 | 7.87 | 0.16 | 12.63 |
| 8.4 | 1.12 | 3.32 | 7.87 | 0.13 | 12.45 |
| 8.5 | 1.08 | 3.21 | 7.87 | 0.11 | 12.27 |
| 8.6 | 1.04 | 3.10 | 7.87 | 0.09 | 12.10 |
| 8.7 | 1.00 | 3.00 | 7.87 | 0.07 | 11.93 |
| 8.8 | 0.95 | 2.90 | 7.87 | 0.04 | 11.77 |
| 8.9 | 0.91 | 2.80 | 7.87 | 0.02 | 11.61 |
| 9 | 0.87 | 2.71 | 7.87 | 0.00 | 11.46 |
| 9.1 | 0.84 | 2.62 | 7.87 | 7.87 | 19.20 |
| 9.2 | 0.80 | 2.54 | 7.53 | 7.87 | 18.74 |
| 9.3 | 0.76 | 2.45 | 7.22 | 7.87 | 18.30 |
| 9.4 | 0.73 | 2.37 | 6.92 | 7.87 | 17.89 |
| 9.5 | 0.69 | 2.30 | 6.64 | 7.87 | 17.50 |
| 9.6 | 0.66 | 2.22 | 6.37 | 7.87 | 17.12 |
| 9.7 | 0.62 | 2.15 | 6.12 | 7.87 | 16.76 |
| 9.8 | 0.59 | 2.08 | 5.89 | 7.87 | 16.42 |
| 9.9 | 0.56 | 2.01 | 5.66 | 7.87 | 16.10 |
| 10 | 0.52 | 1.94 | 5.45 | 7.87 | 15.79 |
| 10.1 | 0.49 | 1.87 | 5.25 | 7.87 | 15.49 |
| 10.2 | 0.46 | 1.81 | 5.06 | 7.87 | 15.20 |
| 10.3 | 0.43 | 1.75 | 4.87 | 7.87 | 14.93 |
| 10.4 | 0.40 | 1.69 | 4.70 | 7.87 | 14.66 |
| 10.5 | 0.37 | 1.63 | 4.53 | 7.87 | 14.41 |
| 10.6 | 0.35 | 1.57 | 4.37 | 7.87 | 14.17 |
| 10.7 | 0.32 | 1.52 | 4.22 | 7.87 | 13.93 |
| 10.8 | 0.29 | 1.47 | 4.08 | 7.87 | 13.70 |
| 10.9 | 0.26 | 1.41 | 3.94 | 7.87 | 13.49 |
| 11 | 0.24 | 1.36 | 3.80 | 7.87 | 13.27 |
| 11.1 | 0.21 | 1.31 | 3.67 | 7.87 | 13.07 |
| 11.2 | 0.19 | 1.26 | 3.55 | 7.87 | 12.87 |
| 11.3 | 0.16 | 1.22 | 3.43 | 7.87 | 12.68 |
| 11.4 | 0.14 | 1.17 | 3.32 | 7.87 | 12.50 |
| 11.5 | 0.11 | 1.12 | 3.21 | 7.87 | 12.32 |
| 11.6 | 0.09 | 1.08 | 3.10 | 7.87 | 12.14 |
| 11.7 | 0.07 | 1.04 | 3.00 | 7.87 | 11.98 |
| 11.8 | 0.04 | 1.00 | 2.90 | 7.87 | 11.81 |
| 11.9 | 0.02 | 0.95 | 2.80 | 7.87 | 11.65 |
| 12 | 0.00 | 0.91 | 2.71 | 7.87 | 11.50 |

FIG. 59

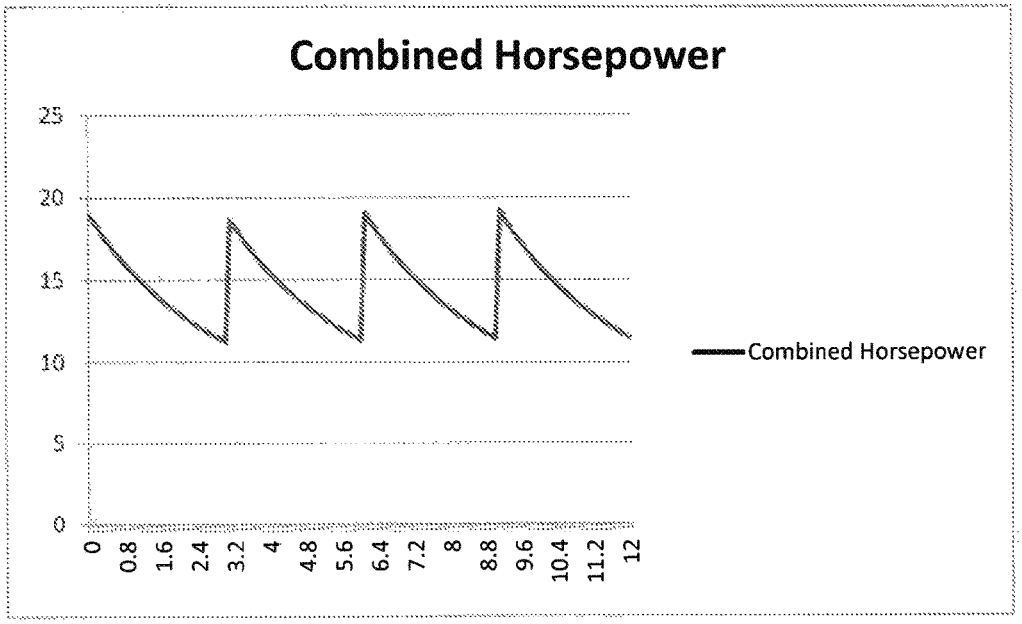

FIG. 60

| | | | |
|---|---|---|---|
| High Side Pressure | | 300 | psi (absolute) |
| Low Side Pressure | | 75 | psi (absolute) |
| Cylinder Diameter | | 3.500 | in |
| Rod Diameter | | 0.625 | in |
| Sprocket Root Diameter | | 4.50 | in |
| Cylinder Stroke Length | | 12.00 | in |
| Time to complete 1 cycle (extend and retract) | | 1.00 | seconds |
| Extending | Stroke length when inlet valve closes | 3.0 | in |
| | Calculated Ending Pressure | 72.5 | psi (absolute) |
| | Average Horsepower | 3.52 | hp |
| Retracting | Stroke length when inlet valve closes | 3.0 | in |
| | Calculated Ending Pressure | 72.5 | psi (absolute) |
| | Average Horsepower | 3.41 | hp |

FIG. 61

HEAT ENGINE WITH LINEAR ACTUATORS

This United States utility patent application claims priority on and the benefit of provisional application 61/772,740 filed Mar. 5, 2013, the entire contents of which are hereby incorporated herein by reference.

This patent application is a continuation-in-part application of application Ser. No. 13/469,306 filed on May 11, 2012, which itself claims priority on and the benefit of U.S. provisional application 61/485,849 filed May 13, 2011, the entire contents of both being hereby incorporated herein by reference.

BACKGROUND OF THE INVENTION

1. Field of the Invention

The present invention relates to a heat engine, and in particular in one embodiment to a rotary style heat engine and in another embodiment to a linear drive heat engine that can have any number of independent cylinders and one way clutches.

2. Description of the Related Art

Heat energy, sometimes called thermal energy, is defines as the kinetic energy of a system's particles. Put another way, the heat energy of a system is the amount of potential energy in a system that is derived from the heat content within the system.

Temperature is not the same as heat energy. Yet, temperature makes up an integral part of the ideal gas law. The ideal gas law states:

$$PV=nRT$$

Wherein:

P is Pressure

V is Volume n is the amount of gas

R is the universal gas constant and

T is temperature

This ideal gas law demonstrates that temperature and pressure are directly related when the other variables are held constant. Likewise, when temperature is held constant in a closed system, the pressure and volume are inversely related.

This is demonstrated as follows:

$$P1*V1=P2*V2$$

That is, the sum of pressure times volume stays constant in a closed system when the temperature remains constant.

It is known that pressure within a system can be used to perform work. For example, in a properly designed system, potential energy of a high pressure container can be extracted by allowing a user to convert potential energy to kinetic energy.

As an example, consider a tank that is under pressure two times atmospheric pressure. The gas will rush out of the tank when a valve is opened until the pressures inside and outside of the tank equalize. Stating this differently, the gas inside the tank expands (from inside to outside the tank) until the pressures equalize. The expansion of the gas can be utilized to perform work.

There have been many engine designs over the years. One design is the Wankel, engine design. The Wankel engine is a four-cycle internal combustion engine that uses a rotating rotor motion instead of reciprocating pistons. The four cycles takes place between a Reuleaux triangle shaped rotor and an epitrochoid-shaped housing.

The housing can be defined as having 360 degrees of rotation. The rotor can generally be described as an equilateral triangle with rounded faces. The sum of internal angles of an equilateral triangle is 180 degrees. In this regard, the rotor revolves around an offset crankshaft wherein the apexes of the rotor contact the housing at all times. An example of this engine 5 design is shown in FIG. 1.

A single rotor engine is considered a three cylinder engine. In this regard, the space or volume between the apexes of the triangle and the housing wall define three chambers. Each chamber acts independently of the other chambers and each undergoes the intake, compression, ignition and exhaust cycles of the four-cycle design. Hence, three power cycles are produces by this engine.

The Wankel engine has been modified in many ways. Some modifications of the Wankel design, as well as examples of other designs are illustrated in the following patents and published application.

U.S. Pat. No. 3,426,525 to Rubin is titled Rotary Piston External Combustion Engine.

U.S. Pat. No. 3,509,718 to Fezer et al. is titled Hot Gas Machine.

U.S. Pat. No. 4,206,606 to Reich is titled Rotary Stirling Cycle Engine. It discloses a rotary Stirling cycle machine comprising at least two chambers, said chambers being epitrochoidal in cross-sectional area and having an upper portion, a middle waist portion and a lower portion, with the first chamber mounted to the second chamber in tandem, each chamber having a seal element attached to the waist portion and disposed inwardly, the crank shaft rotatably mounted within the chambers and extending therethrough with the first crank throw portion within the first chamber being 180.degree. out of phase with the second crank throw portion within the second chamber, the first and second rotor elements rotatably mounted on said respective crank throw portions with each rotor element being limicon shaped in circumference and adapted to register with the upper and lower portions of the respective chambers so that the rotor elements cyclically rotate about the rotating crank shaft from a position in registration with the upper portion to a position in registration with the lower portion, said seal elements being in constant sealing engagement with the respective rotor elements to define first cavities in the upper portions and second cavities in the lower portions, and heater-regenerator-cooler means operatively connected to said first and second cavities to condition a working fluid through repeated Stirling cycles.

U.S. Pat. No. 4,357,800 to Hecker is titled Rotary Heat Engine. It teaches a rotary external combustion heat engine for furnishing mechanical energy from a source of heat. The engine includes a ring-like stator having an oval rotor chamber enclosing a cylindrical rotor eccentrically placed within the chamber to define a high displacement high temperature fluid chamber and a lower displacement low temperature fluid chamber. A plurality of extensible vanes extend outwardly from the rotor in sliding contact with the inner surface of the rotor chamber. A source of heat supplies thermal energy to fluid supplied to the high temperature chamber, while a heat sink cools fluid supplied to the low temperature chamber. An economizer heat exchanger is also provided for preheating the working fluid. The relative position of the rotor within the rotor chamber is adjustable for varying the relative displacement of the fluid chambers to control engine working parameters. In another embodiment, a first heat engine is utilized as a motor and is mechanically coupled to a second heat engine utilized as a heat pump for providing an external combustion heat pump or refrigeration unit.

U.S. Pat. No. 4,760,701 to David is titled External Combustion Rotary Engine. The patent describes an external combustion rotary engine comprising a motor member, a free-piston combustion member and a storage tank serving also as a heat exchanger and located between the motor and the combustor. The motor rotors rotate inside an enveloping structure eccentrically with respect to a power shaft to form alternatively compression and expansion chambers. Compressed air produced thereby is ducted first to the storage tank and then to the combustor for burning fuel to produce combusted gases which are in turn ducted to the storage tank where heat is exchanged between the hot gases and the cooler compressed air. The combusted gas is then expanded in the expansion chambers. A fraction of the compressed air is further compressed to a higher pressure level so that it may be used in air pad cushions to isolate the various engine rotating parts from the fixed structures surrounding them. The use of such air cushions prevents contacts between moving parts and eliminates friction, heat production therefrom and wear. The need for lubrication is thus also eliminated. The "externally" performed fuel combustion is much slower than in comparable internal combustion rotary engines. This results in higher combustion efficiencies, lower combustion temperatures and lower rates of production of pollutants such as NO.sub.x.

U.S. Pat. No. 5,211,017 to Pusic is titled External Combustion Rotary Engine. It shows an external combustion rotary engine having a configuration which allows spatial separation of the heaters and coolers, and a process which enables rotary motion of the rotors to be performed without internal combustion. The engine includes the triangular rotors enclosed inside the housings shaped in the form of an epitrochoid curve, the heat generating units, and the heat absorbing and discharging units. The heat generating units and the heat absorbing and discharging units are located outside the housings and connected to the housings. The engine can also include the ultrasonic fuel atomizers inside the heat generating units and the turbine for the purpose of rapid acceleration. The present invention provides the simple, compact, lightweight, extremely energy-efficient and environmentally clean engine.

U.S. Pat. No. 5,325,671 to Boehling is titled Rotary Heat Engine. It describes an engine energized by an external heat source and cooled by an external cooling source, driven by a closed body of gas contained in chambers of variable volume and passages connected thereto, and operating on a Carnot cycle. The apparatus of the engine also has heat pump capabilities.

U.S. Pat. No. 6,109,040 to Ellison, Jr. et al. is titled Stirling Cycle Refrigerator or Engine employing the Rotary Wankel Mechanism. It illustrates a non-reciprocating Stirling-cycle machine which overcomes problems associated with high drive mechanism forces and vibration that seriously hamper reciprocating Stirling-cycle machines. The design employs Wankel rotors instead of the reciprocating pistons used in prior Stirling machines for effecting the compression and expansion cycles. Key innovations are the use of thermodynamic symmetry to allow coupling of the rotating compression and expansion spaces through simple stationary regenerators, and the coordination of thermodynamic and inertial phasing to allow complete balancing with one simple passive counterweight, which is not possible in reciprocating machines. The design can be scaled over a wide range of temperatures and capacities for use as a cryogenic or utilitarian refrigerator or to function as an external heat powered engine.

United States Patent Application Publication 2009/0139227 to Nakasuka et al. is titled Rotary Heat Device. It has a rotary heat engine having a cylinder and a rotor having a rotating shaft rotatably placed in the cylinder. The cylinder has a heat receiving section for supplying heat to the inside of the cylinder and a heat radiating section for radiating heat from the inside. The engine also has an engine section body and an operation liquid storage section. A vaporized gas supply channel and a gas recovery channel communicating with the inside of the cylinder are provided, respectively, on the heat receiving section side and heat radiating section side of the cylinder in the engine section body. The operation liquid storage section is between the vaporized gas supply channel and the gas collection channel in order to aggregate and liquefy recovered gas and is installed such that both channels fluidly communicate with each other. Also, the operation liquid storage section has a heat insulation dam provided with a through hole for preventing backflow of fluid flowing inside.

While each of these devices may be useful for their intended purposes, none show the unique advantages of one embodiment of the present invention.

Specifically none show an engine utilizing an elongated driving force due to opening of a valve when one of three apexes passes a prior exhaust port and the expansion chamber volume is small.

None show that an input valve can be closed at the appropriate timing whereby pressure in the expansion chamber and the pressure in the system outside of the expansion chamber will be approximately equal when the rotor leading apex passes the exhaust port.

Due to the geometry of adding a second inlet and exhaust ports, modified engines suffer from blow-by at certain times. The blow-by occurs as an expansion chamber will be open to both the inlet and exhaust simultaneously. None show the use of valves to prevent blow-by in a system having three apexes of a triangular rotor and two inlets and two exhaust ports spaced about the engine housing.

None show the use of fixed gates mounted in the housing to decrease expansion chamber volume and increase the portion of driving force about one side of a rotor as the rotor orbits about the housing center point.

Another type of design utilizes a linear drive. Some examples include:

U.S. Pat. No. 3,939,719 to Stovall titled An Improved Power Converter Apparatus shows an apparatus for converting the power of a reciprocating member to unidirectional rotation of an output shaft. A reciprocator is connected to a coupling shaft so as to rotate the coupling shaft in alternating directions. Gears and clutches driven by the coupling shaft convert the alternating movement of the coupling shaft to unidirectional rotation imparted to the output shaft. In other embodiments, the reciprocator drives coupling shafts which in turn impart alternating movement to clutch assemblies that cooperate to alternately impart unidirectional rotation to the output shaft.

U.S. Pat. No. 3,973,445 to Ballard titled Conversion Mechanism for Linear to Rotary Motion relates to mechanism for converting linear motion to rotary motion without the use of a crank or crankshaft. Two circular members which may be provided with teeth are driven simultaneously in opposite directions by a chain, belt or rack which is in turn connected to a piston reciprocating in a linear path. The invention is particularly adapted to vapor engines sometimes referred to as expanders. It also comprises both electrically and mechanically actuated valve motions, including a reverse means and means for varying cut-off.

U.S. Pat. No. 4,702,147 to Johnson, et al. titled Engine with Pneumatic Valve Actuation shows an invention providing a valving arrangement for a reciprocating engine in which there are two valve assemblies, each with a pressure responsive valve member. As the piston approaches the end of its stroke in either direction, the exhaust port is closed, such as by an extension on the piston, causing fluid pressure to build up in the end of the cylinder. This pressure is conducted to the valve assemblies through fluid lines, causing the pressure-responsive valve members to move in response to the pressure build-up in the end of the cylinder. These valve members control the inlet and exhaust connections to the cylinder so that the piston is caused to reciprocate by the working fluid as the valve members are moved pneumatically to open and close the lines.

U.S. Pat. No. 5,461,863 to Simonds titled Transducer for Converting Linear Energy to Rotational Energy shows that multiple steam powered cylinders reciprocate to pivot arms back and forth connected to output drive shafts through one way clutches with the output drive shafts being interconnected through gears such that when one shaft is powered, the other is coasting. The inlet and outlet valves for each cylinder chamber are controlled by an actuator which instantaneously snaps the valves between open and closed positions. The power cylinders may be operated individually, in parallel or in series and as required, a valve passageway through the piston may be operated to equalize pressure. A pair of O-rings on the piston engage the cylinder wall only when the adjacent chamber is pressurized, thereby reducing drag in operation of the piston.

While each of these devices may be useful for their intended purposes, none shows the unique advantages of another embodiment of the present invention.

None of these patents shows an engine with multiple double acting or two way actuators each operable with two one way clutches.

None of these patents shows an engine with multiple double acting or two way actuators each being in offset phase of driving force.

None of these patents shows a double acting or two way actuator operable with two one way clutches wherein each clutch turns a shaft and the shafts are coupled with a chain to achieve a unidirectional driving force.

Thus there exists a need for a heat engine that solves these and other problems.

SUMMARY OF THE INVENTION

In one embodiment of the present invention, it relates to a heat engine having a housing. A generally triangular shaped rotor can drive an offset crank as it eccentrically rotates within the housing. Two inlets with valves and two exhausts are provided. The volume between each face of the rotor and the housing defines three expansion chambers. Six power cycles are provided (one by each expansion chamber times two inlets) per revolution of the rotor. Each valve controls the length of time that high pressure gas is allowed to enter each expansion chamber. The valves are controlled by a processor and close when enough pressure is supplied so that the pressures inside and outside the expansion chamber are equal when the chamber is fully expanded just prior to exhaust. Gates can provide a mechanical advantage to the rotor by reducing the amount of pressure applied to the back side of the fulcrum.

According to one advantage of the present invention, the engine utilizes an elongated driving force due to opening of a valve when one of three apexes passes a prior exhaust port and the expansion chamber volume is small. The faces of the rotor are smooth and undished in order to minimize the volume in each chamber when the valve first opens.

According to another advantage of the present invention, the input valve can be closed at the appropriate timing whereby pressure in the expansion chamber and the pressure in the system outside of the expansion chamber will be approximately equal when the rotor leading apex passes the exhaust port. In this regard, the efficiency of the expansion phase is maximized because all of the energy is utilized as the pressures are equalized when the system opens to the exhaust.

According to further advantage of the present invention, the use of valves prevents blow-by in the system. Blow-by would otherwise occur in a system having three apexes of a triangular rotor and two inlets and two exhaust ports spaced about an engine housing since at times in the revolution of the rotor a chamber would be open to both an inlet and an exhaust port at the same time. Using a valve prevents this occurrence from happening.

According to a still further advantage of the present invention, fixed gates are provided to decrease expansion chamber volume (start of the expansion) and also to increase the mechanical advantage of the rotor during the expansion (the portion of driving force about one side of a rotor as the rotor orbits about the housing center point). The side of the rotor upon which driving force acts is called the positive side of the fulcrum. Further, the undished face allows the gates to fully divide the expansion chambers into two portions due to being able to fully engage the rotor.

The gates can have a selected angular alignment whereby pressure within the expansion chamber acts to force the gates against the rotor face to form a strong seal.

The use of gates also allows the exhaust ports to be moved to different locations about the housing. In one embodiment, the pressure can be applied over about 30 degrees of rotation. However, by adding the gate and moving the outlet, the pressure can be applied over approximately 70 degrees of rotation, greatly increasing the driving force applied to the rotor.

According to a still further advantage of the present invention, the engine has six power cycles per revolution. This is due to three expansion chambers and two inlets. Each power cycle is offset from each other, whereby the combined power curve is smoothed out.

According to a still further advantage of the present invention, a processor is provided to control the opening and closing of the valves. The opening will be at a set point when the volume in the expansion chamber is at or near a minimum. The processor interprets both the input and exhaust pressures and closes the input valve at an exact time which allows for the high pressure gas entering the chamber to fully expand and be approximately equal to the pressure on the low pressure side of the system at exhaust.

According to a still further advantage of the present invention, a partial vacuum can be provided as the gas cools in the condensation chamber. This lower pressure can help to pull to rotor around its rotation.

According to another embodiment of the present invention, it relates to a heat engine having shafts with gears, position gears and a plurality of actuators each having gears. Energy can be harnessed from the first shaft as it rotates. The second shaft can be coupled to the first shaft to transfer energy from the second shaft to the first shaft. One coupler is a chain. Position gears orient the chain wherein the rotation of the second shaft is inverted upon the first shaft so that the first shaft has a constant rotational orientation. Each actuator is preferably a double acting actuator that can supply force to both push and pull upon a belt connected to the actuator rod. A 1-way clutch and gear connects the belt to each shaft wherein the belt (driven by actuator) imparts a positive force upon the first shaft on the out stroke and a positive force upon the second shaft on the return stroke.

According to one advantage of the present invention, the actuators are linear double acting or two way actuators. In this regard, the actuators provide positive pressure in both the extension or out stroke and the retraction or return stroke.

According to another advantage of the present invention, there is preferably a plurality of independent actuators. In this regard, the output power of the engine approaches a relative uniform output.

According to another advantage of the present invention, the timing of the actuators is offset. In a preferred embodiment, the phase timing is calculated as the inverse of the number of actuators. Advantageously, having an offset phase of multiple actuators eliminates a dead spot (when an individual actuator is fully extended or retracted immediately before being energized to move in the opposite direction).

Related, and according to a further advantage of the present invention, a position sensor is provided (and coupled to the belt of the first actuator) so that the position of the actuator is known. Since the timing of each actuator is offset, knowing the position of all actuators is known when the position of any one of them is known (via the processor and encoder).

According to another advantage of the present invention, each actuator is independently energized. In this regard, failure or problems with a single actuator will not directly result in failure or problems with the other actuators.

According to another advantage of the present invention, the actuator cylinder has two ports. Each port has a valve that is closed via a processor at an appropriate time wherein the pressure inside the port equals the pressure outside the port at the end of the stroke. The closing of the valve is determined by the formula $P1 \times V1 = P2 \times V2$ wherein P1 is the pressure on the input side of the cylinder, V1 is the volume within the cylinder when the valve closes, P2 is the low pressure on the exhaust side of the cylinder and V2 is the volume of the cylinder when the stroke is complete (fully extended or retracted).

In this regard, the actuator can utilize a full amount of energy (potential energy of expanding gas) in each stroke direction. The valves on the back side of the piston head are open during the actuator stroke to exhaust gas from the cylinder (i.e. first valve open on return stroke and second valve open on extension stroke).

According to a further advantage of the present invention, the output force of the actuators is cumulative. This allows the individual force of each actuator to be extracted even if individually the actuator does not have enough force remaining to rotate a shaft (at or near the end of the stroke).

According to another advantage of the present invention, 1-way clutches are provided. In this regard, the clutches allow force to be transferred from the actuator to a shaft in one direction, and allowed to rotate about the shaft without transferring energy in the other direction. Advantageously, this allows a belt to be used as it imparts a force while under tension and will not need to carry a load under compression.

According to a further advantage of the present invention, position gears are provided to position a chain that couples the shafts. In this regard, the chain can be positioned to invert rotation of the second shaft onto the first shaft. This can be accomplished by going over the top of one shaft and under the bottom of the other shaft, as the shafts rotate in opposite rotational orientations under the push and pull of the actuators. Inversion of the rotational force advantageously allows the first shaft to maintain rotation in a single rotational orientation (unidirectional driving force).

According to a still further advantage yet of the present invention, an engine with multiple double acting or two way actuators each operable with two one way clutches is provided.

According to a still further advantage yet of the present invention, an engine with multiple double acting or two way actuators each being offset in driving force is provided.

According to a still further advantage yet of the present invention, a double acting or two way actuator operable with two one way clutches wherein each clutch turns a shaft and the shafts are coupled with a chain to achieve a unidirectional driving force is provided.

Other advantages, benefits, and features of the present invention will become apparent to those skilled in the art upon reading the detailed description of the invention and studying the drawings.

BRIEF DESCRIPTION OF THE DRAWINGS

FIG. 53 is a chart of the data supporting the chart of FIG. 52.

FIG. 54 is a chart showing actuator operation data.

FIG. 55 is a schematic view of a valve showing input and exhaust routing.

FIG. 57A is a chart showing actuator data in an extension stroke.

FIG. 57B is a chart showing additional actuator data in an extension stroke.

FIG. 58A is a chart showing actuator data in a retraction stroke.

FIG. 58B is a chart showing additional actuator data in a retraction stroke.

FIG. 59 is a chart showing combined horsepower data of actuators having an offset timing.

FIG. 60 is a graph showing the combined horsepower illustrated in FIG. 59.

FIG. 61 is a chart showing preferred operating parameters.

DETAILED DESCRIPTION OF THE PREFERRED EMBODIMENTS

While the invention will be described in connection with several embodiments, it will be understood that it is not intended to limit the invention to those embodiments. On the contrary, it is intended to cover all alternatives, modifications and equivalents as may be included within the spirit and scope of the invention as defined by the appended claims.

A first embodiment can be viewed by looking at FIGS. 1-28.

Figure 1:
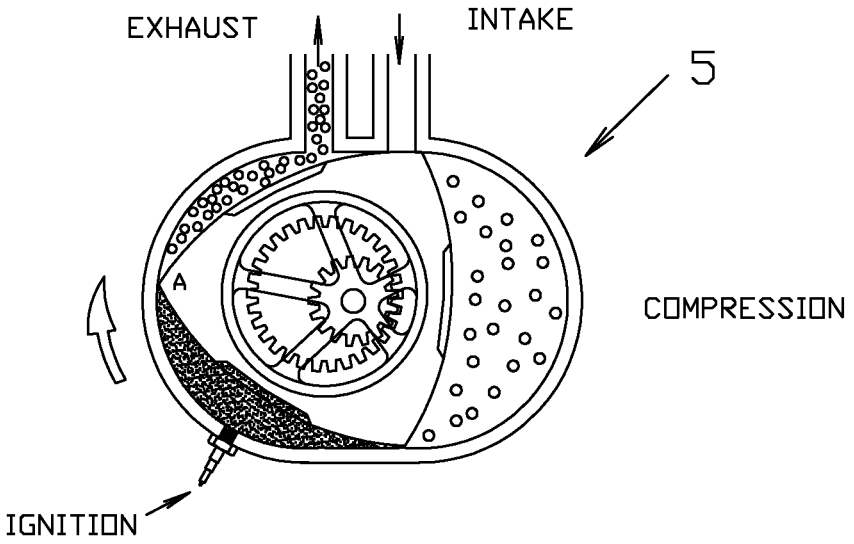
FIG. 1 PRIOR ART
FIG. 1 is a schematic view of a traditional Wankel style engine.
Figure 2A:
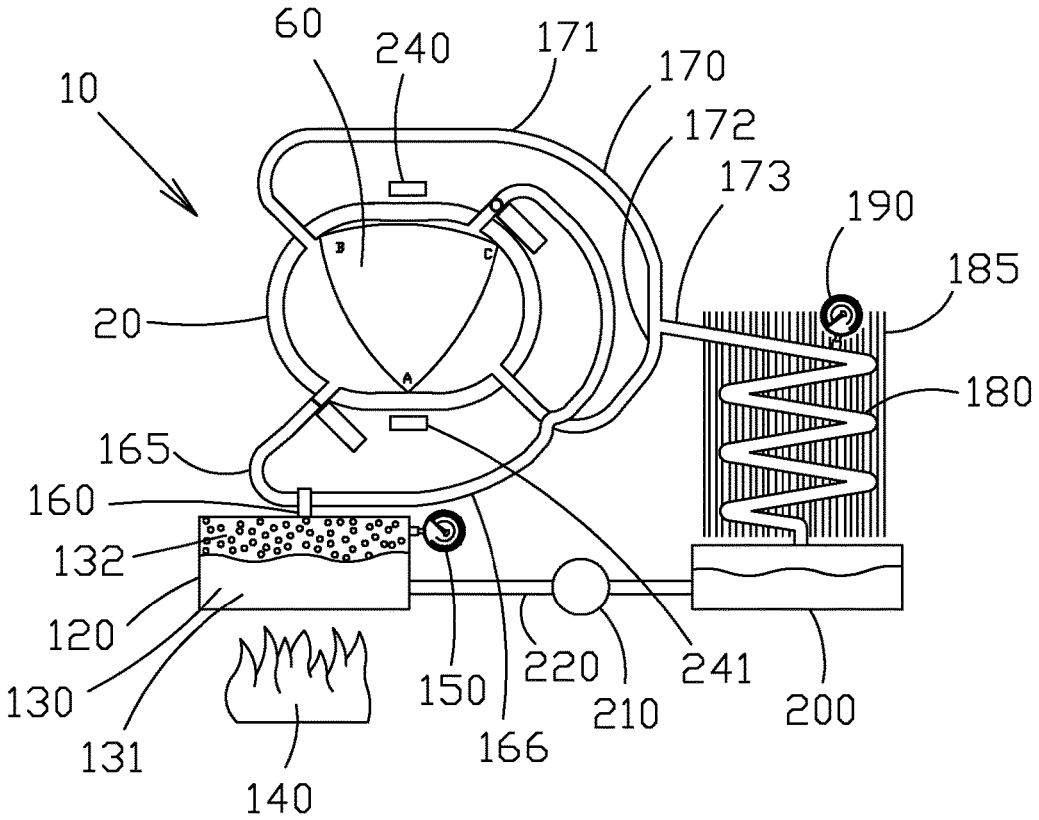
FIG. 2A is a schematic view of a preferred embodiment of the present invention.

Looking now to FIG. 2A, it is seen that an engine 10 is provided having a housing 20. A rotor 60 is further provided. The rotor 60 rotates within the housing 20 as described below.

A high pressure tank 120 is provided. The tank can be any suitable size. The tank 120 can hold a selected amount of working medium 130. The working medium is preferably a commonly available refrigerant that undergoes a phase change between liquid 131 and gas 132 at predictable temperatures and pressures. One preferred refrigerant is R-123. However it is understood that other refrigerants could be used without departing from the broad aspects of the present invention.

A heat source 140 is provided. The heat source 140 is in close proximity to tank 120, whereby the heat source can heat the working medium 120 causing selected amounts of liquid 131 to undergo a phase change to gas 132. The tank can hold the gas at high pressures. It is understood that operating pressures and temperatures are determined based on system requirements and refrigerants used. A gauge 150 is provided for measuring the pressure in the high pressure tank 120.

A high pressure delivery system 160 is provided. The high pressure delivery system 160 can be split into two lines, a first line 165 and a second line 166. The lines are fluidly connected wherein the pressure in each line 165 and 166 are preferably the same. The high pressure delivery system 160 provides high pressure gas to the housing 20 of the engine 10.

A low pressure exhaust system 170 is further provided. The low pressure exhaust system receives low pressure exhaust from the housing 20 of the engine. The low pressure exhaust system has a first line 171 and a second line 172. The first and second lines 171 and 172, respectively, combine in line 173.

The low pressure exhaust 170 goes through a condensation chamber 180 having a heat exchanger 185. The condensation chamber 180 has a gauge 190 to measure pressure within the system on the low pressure side of the system. The condensation chamber 180 empties liquid condensate into a low pressure condensation tank 200 via line 220. From there, a pump 210 is used to route liquid 131 back into the high pressure tank 120 to repeat the cycle.

Figure 2B:
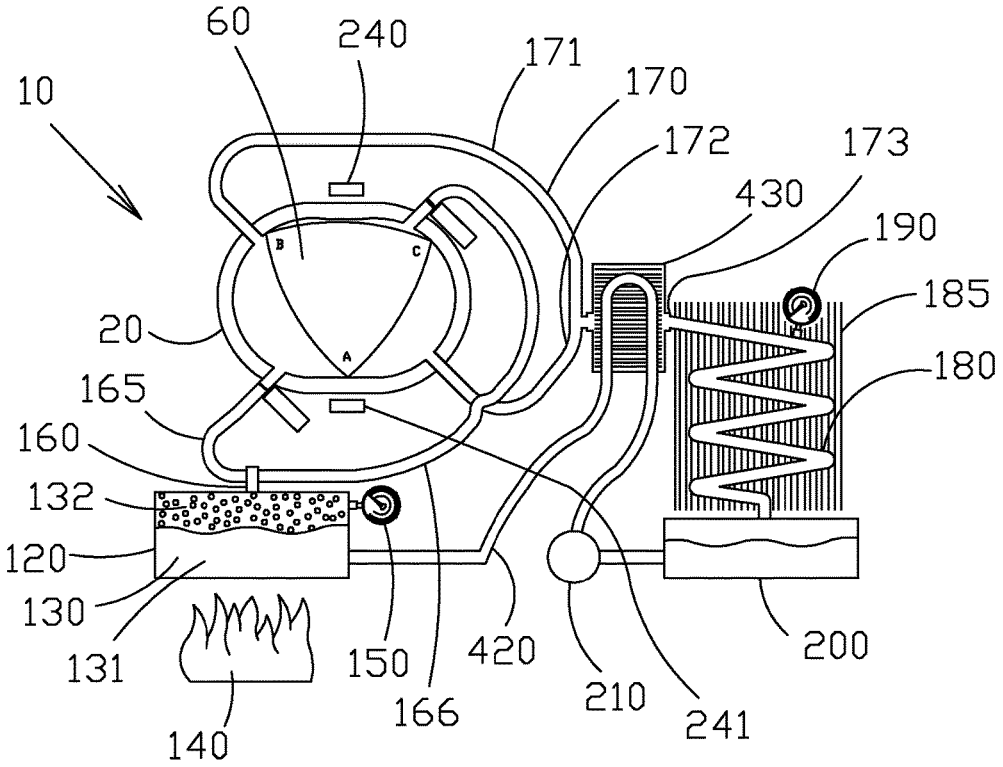
FIG. 2B is similar to FIG. 2A, but shows an additional reheat circuit between a pump and a high pressure tank.

Looking briefly at FIG. 2B, it is seen that an alternative line 420 can be provided to route liquid through a heat exchanger 430 prior to entering the high pressure tank to pre-heat the liquid.

Figure 3:
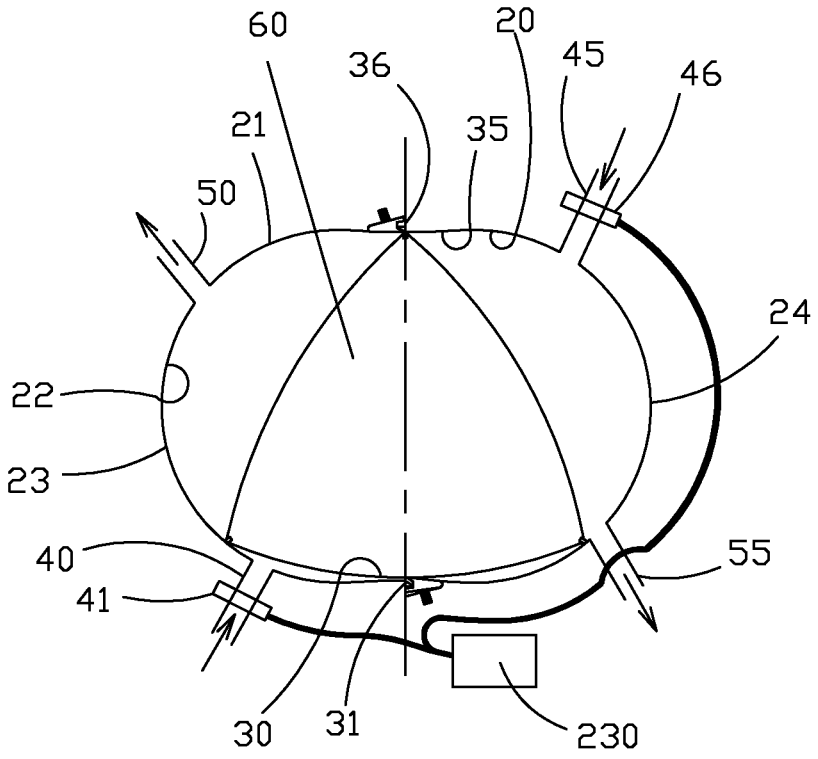
FIG. 3 shows a controller in electrical communication with a first valve and a second valve.

A processor 230 is provided. The processor 230 communicates with position sensors or locators 240 and 241 (which monitor the location of the rotor 60 within the housing 20). The processor 230, as seen in FIG. 3, is also in communication with valves 41 and 46, described below. The processor controls the opening and closing of the valves 41 and 46.

Turning now to FIGS. 4-15, it is seen how the rotor 60 moves about the housing 20.

The housing 20 has a wall 21 with an inside surface 22. The inside surface defines a general epitrochoid shaped structure having a first section 23 and a second section 24. The sections are generally open to each other, but have a first radius 30 and second radius 35 there between. The radii 30 and 35 protrude a small amount toward the center of the housing 20. The radii 30 and 35 have openings or recesses 31 and 36 respectively, to accommodate stationary gates (described below). The openings preferably span from the top to the bottom or the full dimension of the housing and are complimentary in shape to the respective gates. It is appreciated that the openings or recesses may not span the full dimension so long as they support gates that do span the entire dimension.

The housing has an inlet 40 with a valve 41, an inlet 45 with a valve 46, an outlet 50 and an outlet 55. The inlets 40 and 45 are spaced apart (preferably approximately 180 degrees on separate sides of the housing) and are separated by outlets 50 and 55. The valves 41 and 46 are preferably selectably opened and closed under the direction of the processor 230 based on the location of the rotor 60 within the housing 20.

The rotor 60 is generally reuleaux shaped. In this regard, the rotor 60 has three faces, namely a first face 65, a second face 66 and a third face 67. The faces meet at apexes, namely the apex A 70, apex B 71 and apex C 72. Seals 75, 76 and 77 are provided respectively at apex A 70, apex B 71 and apex C 72. The rotor 60 is shown prospectively in FIG. 20. Faces 65, 66 and 67 are preferably smooth and are formed without cavities or other recesses therein. In this regard, the faces travel closely to the inside surface 22 of the housing.

It is understood that the seals actually contact the housing, but for sake of simplicity in description, it is described herein as apex's passing certain points such as inlets and exhausts.

Figure 18:
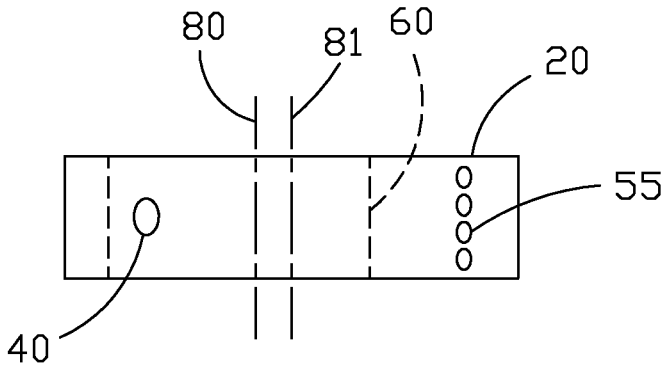
FIG. 18 is a side view of FIG. 17.

As is best seen in FIG. 18, the housing 20 has a center or fulcrum 81. The rotor has a center line 80 as well. The rotor center line 80 is offset from the fulcrum 81 a selected amount as the rotor 60 rotates in an eccentric manner about the housing 20. The frame of reference of the viewer determines the direction of rotation. For example, staying with FIG. 18, the rotor rotates in a clockwise direction within the housing. However, the direction of rotation would be opposite if the field of view likewise is opposite.

A first expansion chamber 90, a second expansion chamber 100 and a third expansion chamber 110 are provided. The expansion chambers are located between the rotor 60 and the housing 20. A driving force is provided in an expansion chamber due to the offset orientation of the fulcrum and the rotor center.

It is understood, looking at FIGS. 4-15, that one of the expansion chambers may be exposed to either the first inlet and first outlet or the second inlet and second outlet simultaneously. However, since the first inlet and second inlet both are valved (and can be closed) blow-by is prevented in the present invention as the respective valves will be closed when the condition exists when the expansion chambers are so exposed.

A gate 250 is provided and shown in FIGS. 4-15 and 24-26. Gate 250 is preferably removably received (via the top or bottom of the housing) within opening 31 of radius 30. Gate 250 has a first end 251 pivotally held within the opening 31 and a second end 252 that contacts the rotor 60 at a tip. End 252 of gate 250 is opposed to end 251 of gate 250. A face 253 is provided facing the rotor 60 and a back 254 is provided facing the inside of the opening 31. A spring 255 is provided for biasing the end 252 of gate 250 away from the opening 31 and towards the rotor 60. A seal 256 is provided on the rear side of the gate. Gate 250 preferably spans the entire height of the housing 20. Gate 250 has a lip 257 that engages in inside wall of the opening to hold the gate 250 within the opening so that the gate cannot escape from the opening.

A gate 260 is further provided. Gate 260 is identical to gate 250. Gate 260 is removably received within opening 36.

As seen in FIGS. 27A-27E, the gate 250 preferably engages the rotor from approximately 20 degrees before top dead center until approximately 20 degrees after top dead center, and lets off the rotor at approximately 30 degrees after top dead center. The gate 250 bifurcates the expansion chamber when it contacts the rotor, whereby it prevents pressure from acting on the rotor behind the gate. Bifurcation or splitting of the expansion chamber into two parts is accomplished since the rotor faces are undished so that the gates can engage the rotor.

Figure 17:
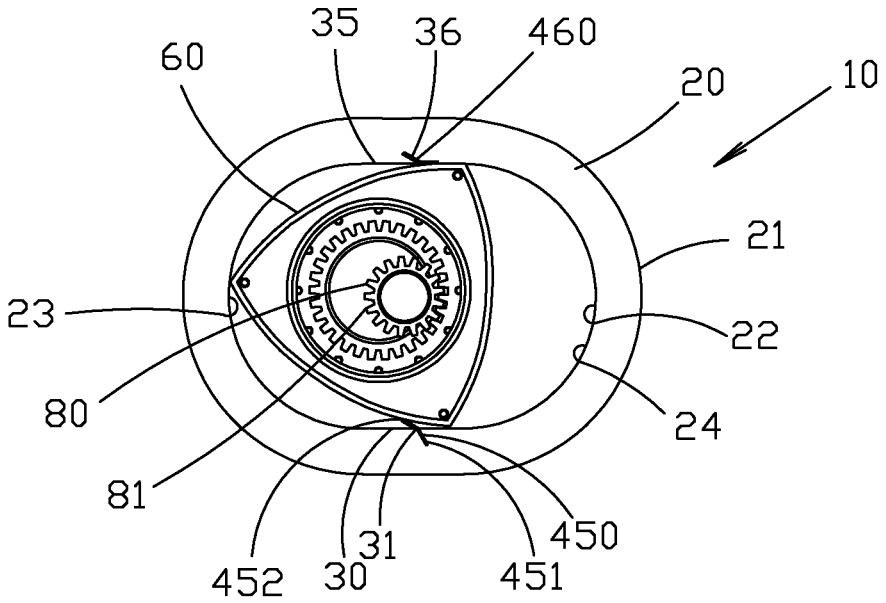
FIG. 17 is a top view of an embodiment of the present invention including an alternative gate structure.
Figure 22:
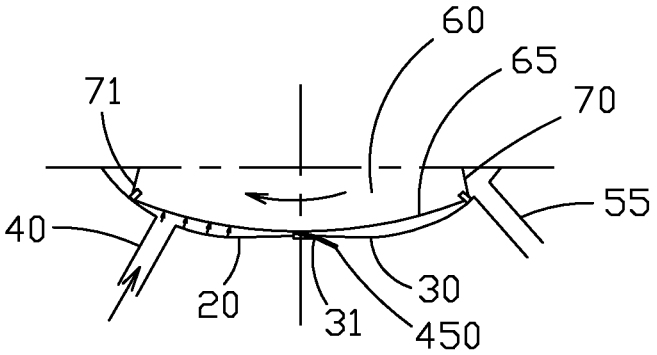
FIG. 22 is a close up view showing an alternative embodiment of a gate with the rotor in a selected position.
Figure 23:
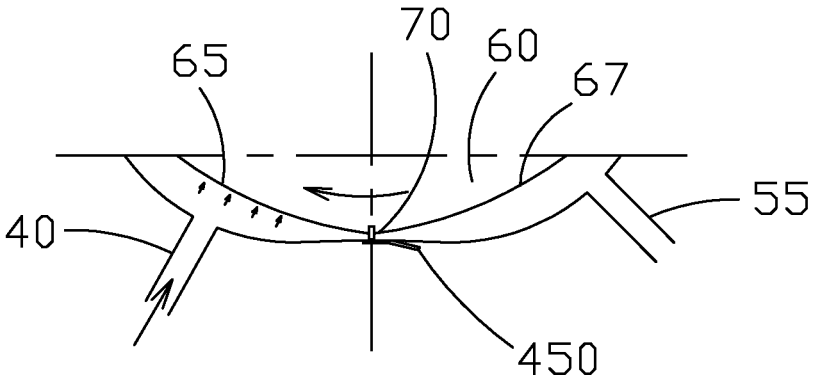
FIG. 23 is similar to FIG. 22, but shows the rotor in a different position.
Figure 24:
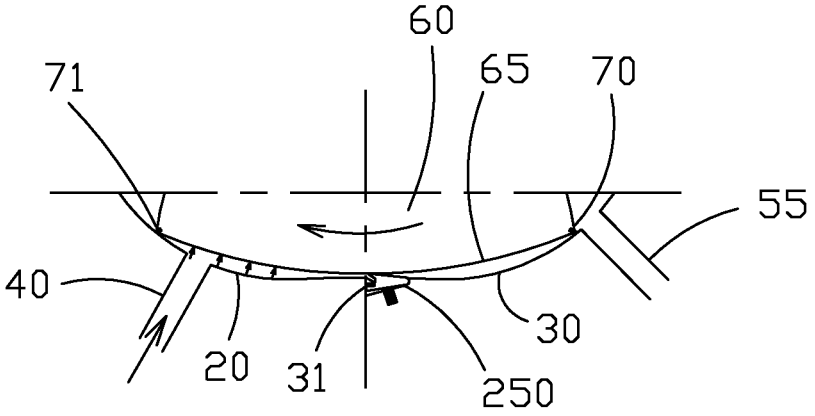
FIG. 24 is a close up view showing an alternative embodiment of a gate with the rotor in a selected position.
Figure 25:
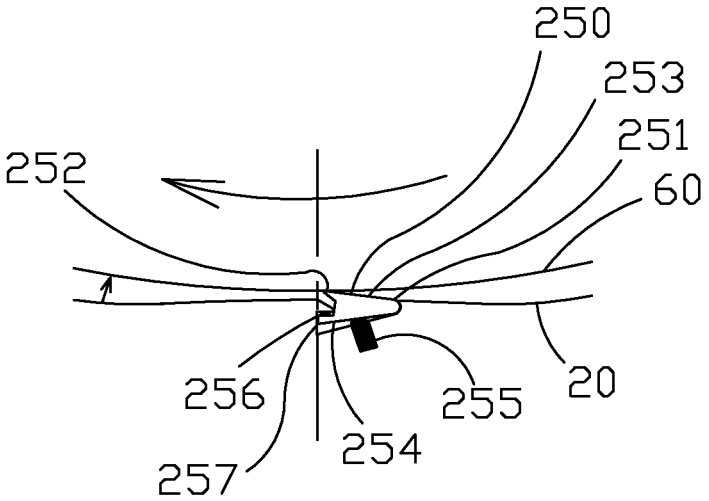
FIG. 25 is a close up view of the gate illustrated in FIG. 24.
Figure 26:
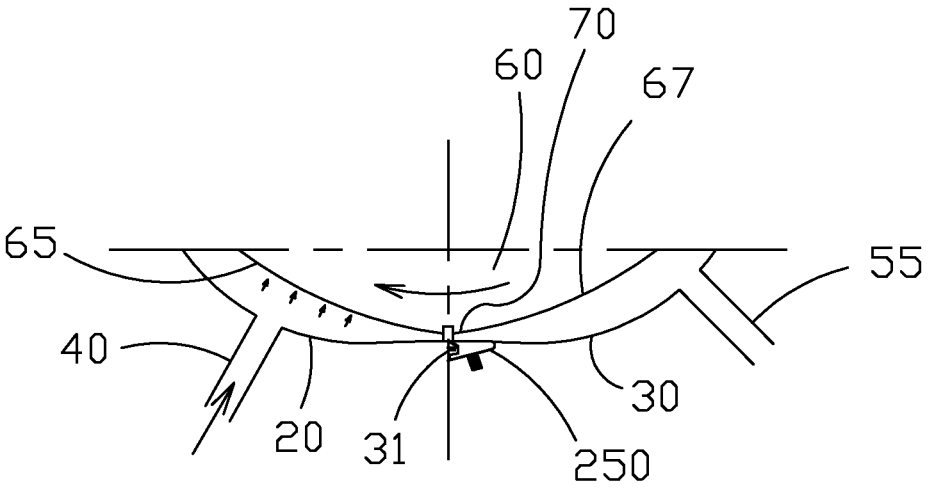
FIG. 26 is similar to FIG. 25, but shows the rotor in a different position.
Figure 27A:
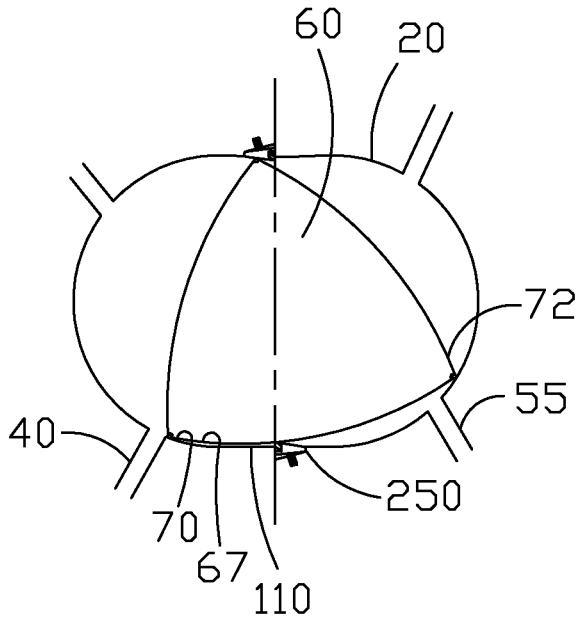
FIG. 27A is a schematic view with an apex approximately 20 degrees before top dead center.
Figure 27B:
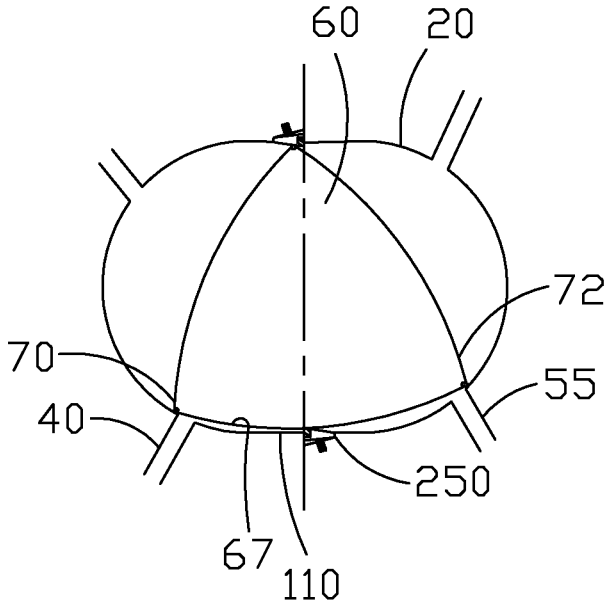
FIG. 27B is a schematic view with an apex approximately 10 degrees before top dead center.
Figure 27C:
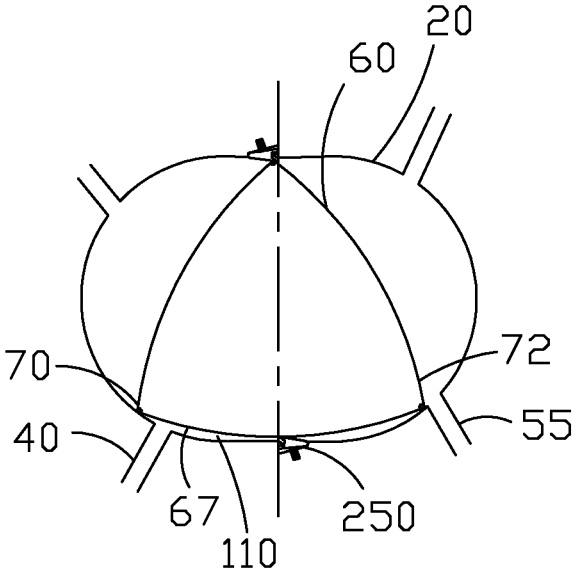
FIG. 27C is a schematic view with an apex approximately at top dead center.
Figure 27D:
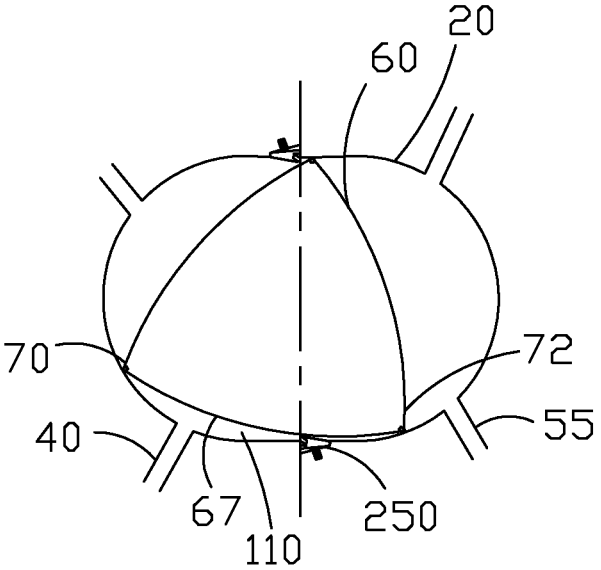
FIG. 27D is a schematic view with an apex approximately 10 degrees after top dead center.
Figure 27E:
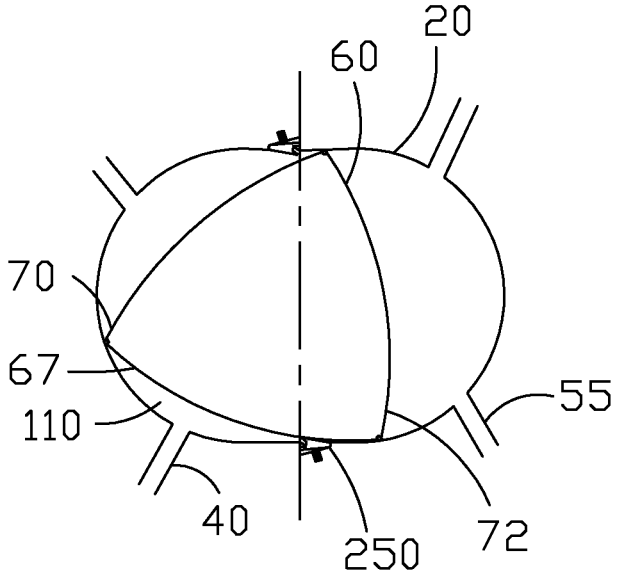
FIG. 27E is a schematic view with an apex approximately 20 degrees after top dead center.
Figure 27F:
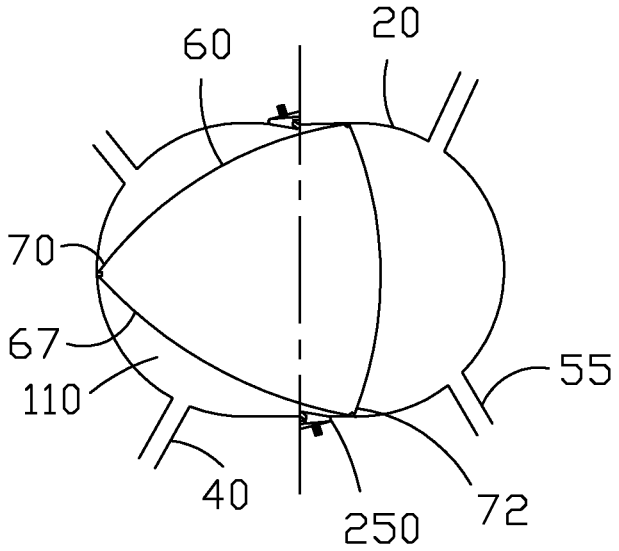
FIG. 27F is a schematic view with an apex approximately 30 degrees after top dead center, wherein the bottom gate ceases to seal the bottom expansion chamber.

An alternative gate 450 is illustrated in FIGS. 17, 22 and 23. Gate 450 has ends 451 and 452. Gate 450 can be a flat piece of spring steel that bends or pivots. The gate is biased to be flat, but can be bent or pivoted to contact the rotor 60. In this embodiment, a slot or slit can form the opening in the radius and the gate 450 can be press fit or adhesively held within the opening. It is appreciated that the gate 450 projects from the housing wall in a slanted manner toward the adjacent inlet and away from the adjacent outlet.

Gate 460 can be provided and is similar to gate 450.

It is understood that the portions of the gates within the housing are movable. It is preferred that the gates are movable from a first gate position wherein the gate is flush with the housing wall to other positions wherein the gate either contacts the rotor or is projected into an expansion chamber without contacting the rotor. The gates preferably are operable to rotate in the same direction as the rotor. This allows pressure to press the gates against the rotor, as well as allowing the rotor to slide over the gates.

Figure 16A:
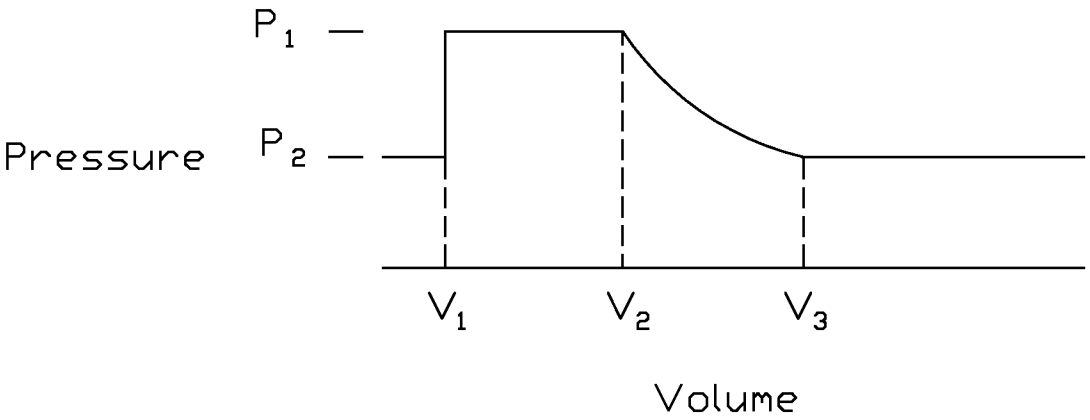
FIG. 16A is a chart showing Pressure vs. Volume within an expansion chamber of the present invention.

As seen in FIG. 16, there are three volumes, V1, V2 and V3 respectively that occur at different times for each of the three expansion chambers of the rotor 60.

V1 is that volume occurring when an inlet valve opens. This occurs when the leading apex passes an inlet and the trailing edge passes an exhaust.

V2 occurs when the rotor advances a sufficient amount to a maximum efficiency point. The maximum efficiency point occurs when the input valve closes at a volume so that the high pressure gas entering the expansion chamber is allowed to fully expand and be equal to the pressure on the low pressure side of the system when the leading apex reaches the exhaust port and the volume is at V3.

Figure 4:
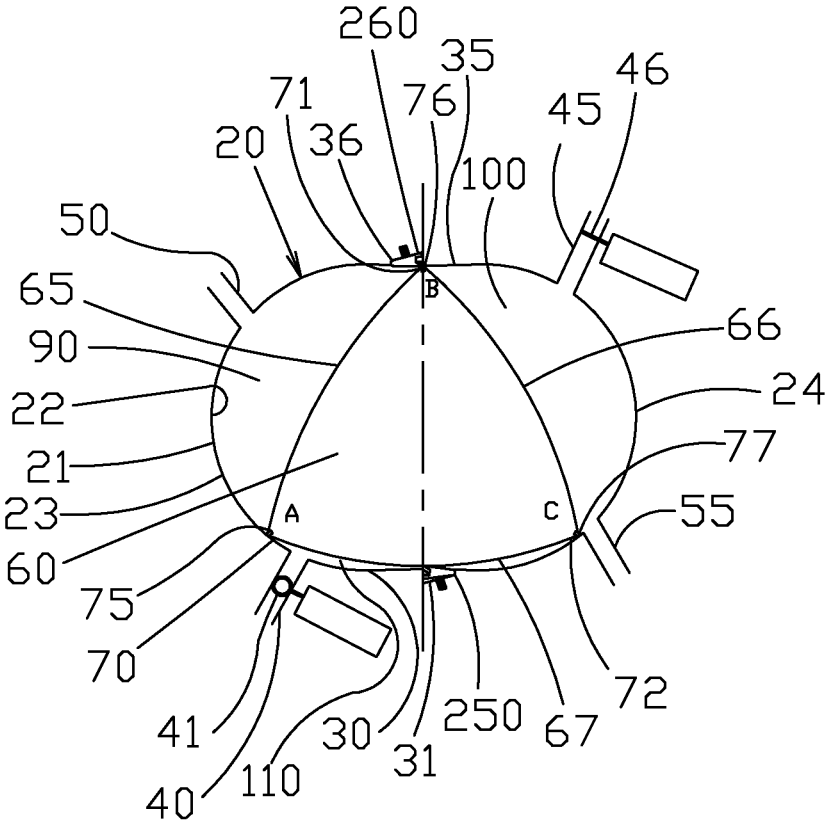
FIG. 4 is a top view showing the rotor in selected position within the housing.
Figure 5:
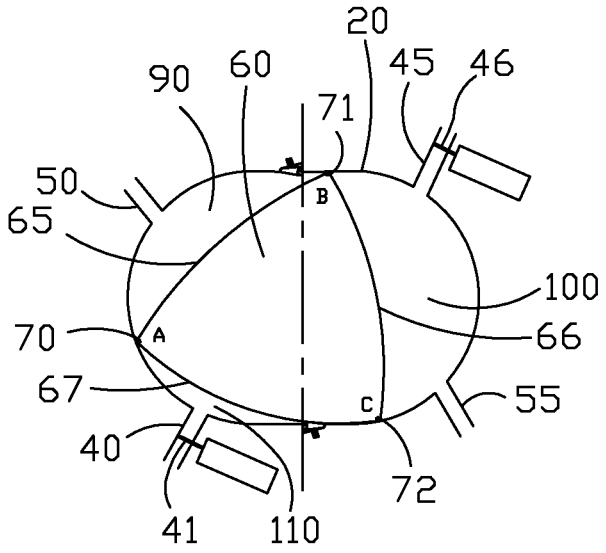
FIG. 5 is a top view showing the rotor in selected position within the housing.
Figure 6:
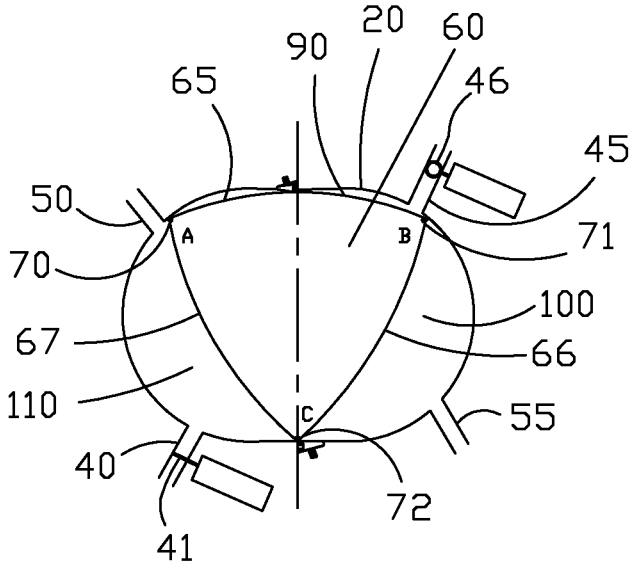
FIG. 6 is a top view showing the rotor in selected position within the housing.
Figure 7:
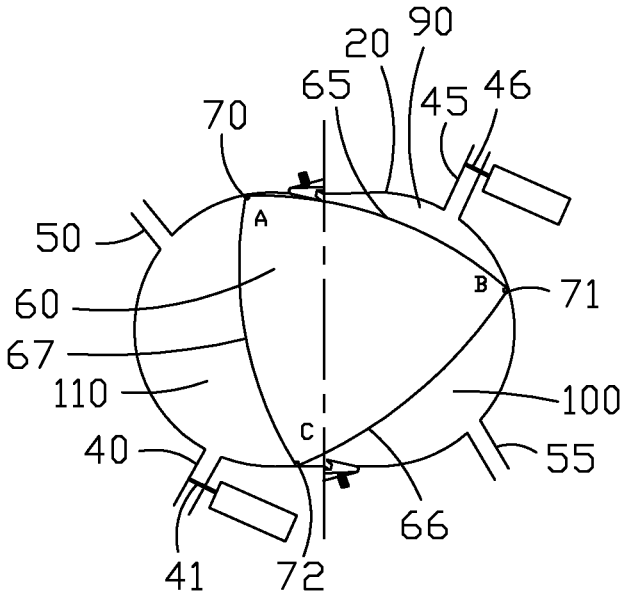
FIG. 7 is a top view showing the rotor in selected position within the housing.
Figure 8:
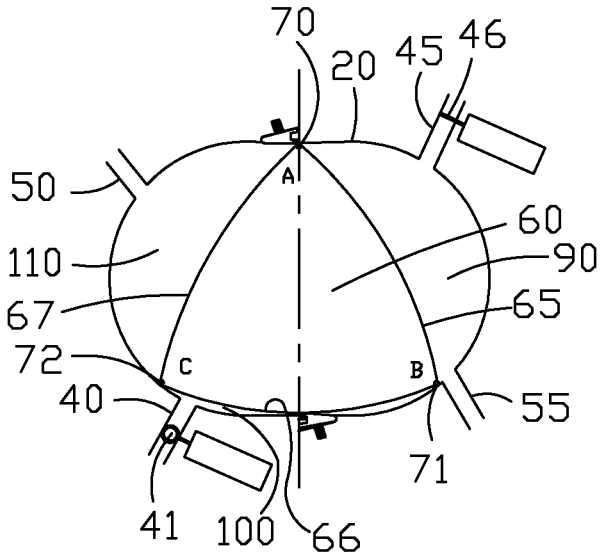
FIG. 8 is a top view showing the rotor in selected position within the housing.
Figure 9:
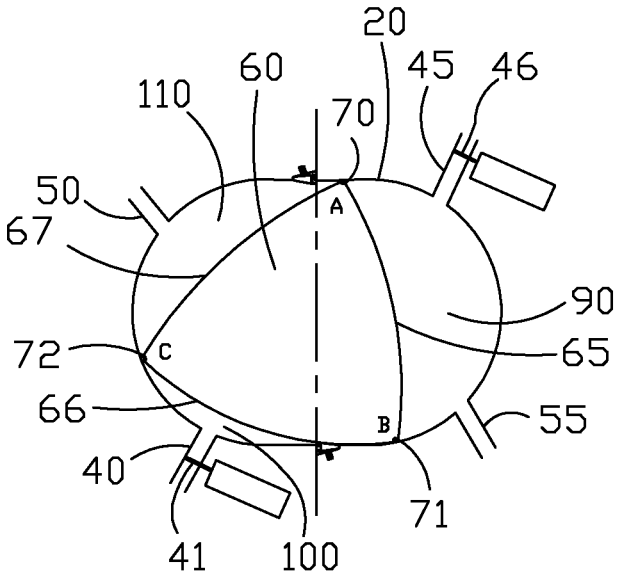
FIG. 9 is a top view showing the rotor in selected position within the housing.
Figure 10:
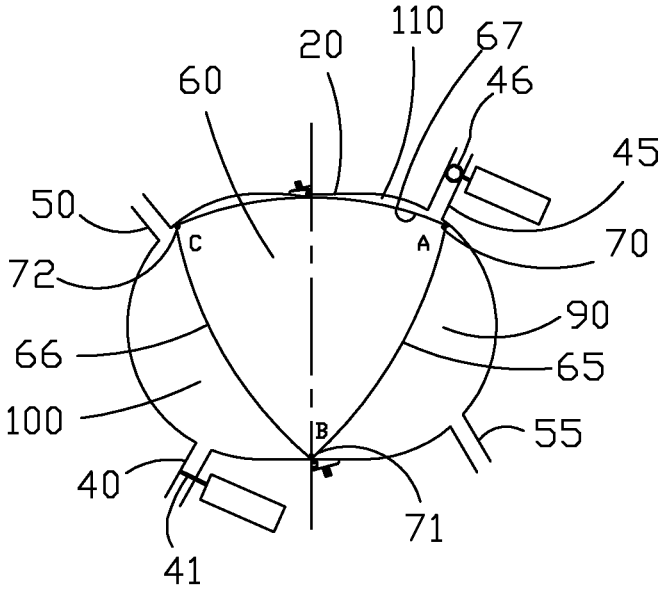
FIG. 10 is a top view showing the rotor in selected position within the housing.
Figure 11:
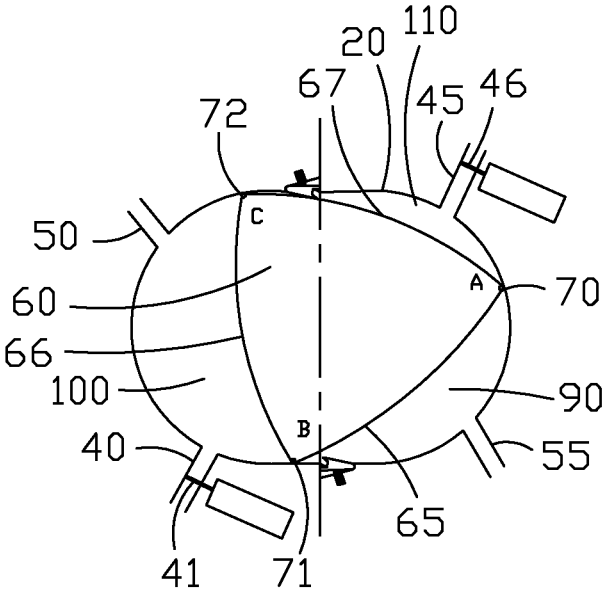
FIG. 11 is a top view showing the rotor in selected position within the housing.
Figure 12:
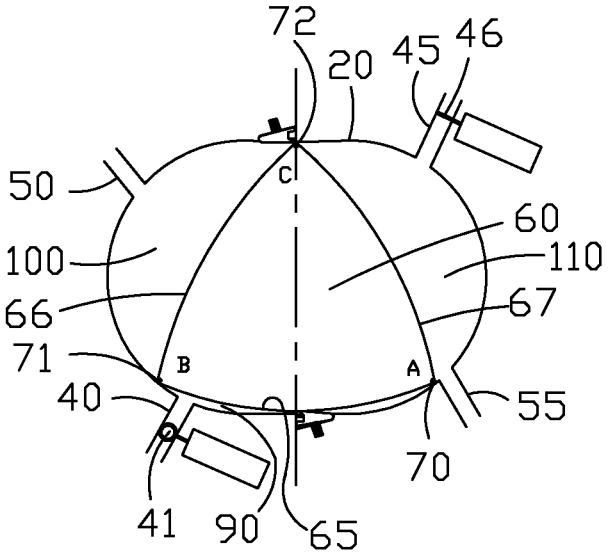
FIG. 12 is a top view showing the rotor in selected position within the housing.
Figure 13:
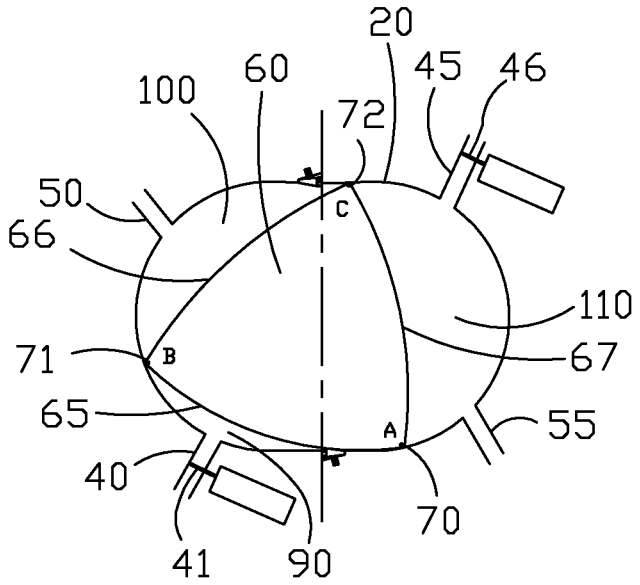
FIG. 13 is a top view showing the rotor in selected position within the housing.
Figure 14:
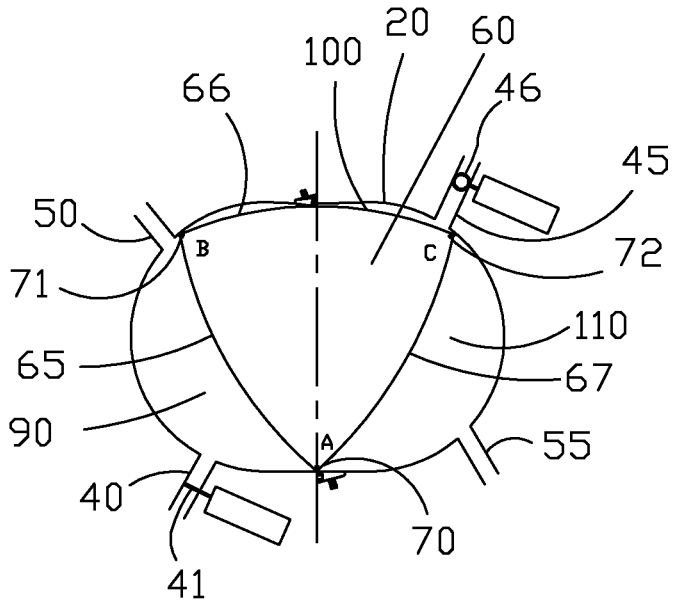
FIG. 14 is a top view showing the rotor in selected position within the housing.
Figure 15:
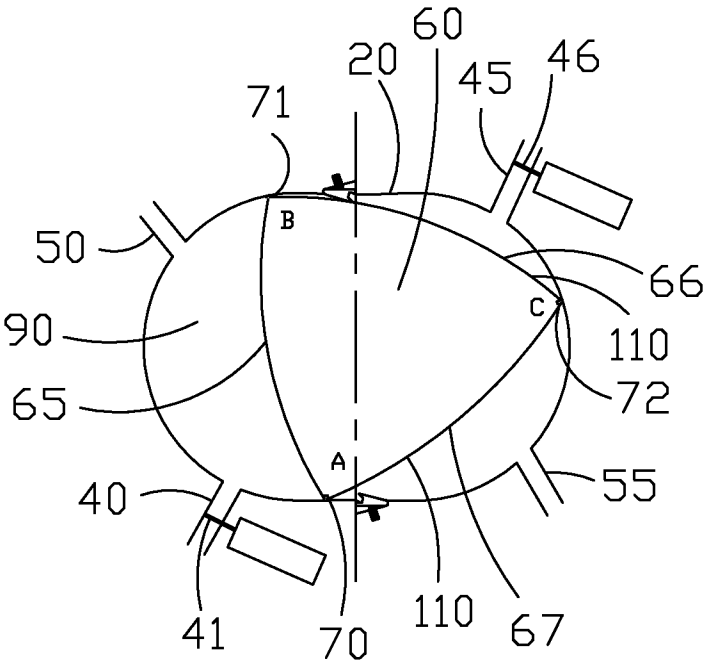
FIG. 15 is a top view showing the rotor in selected position within the housing.

FIGS. 4-15 represent a full cycle of the rotor 60 within the housing 20. The state of each expansion chamber as shown in these drawings is shown in the following table:

| | Expansion Chamber 1 | Expansion Chamber 2 | Expansion Chamber 3 |
|---|---|---|---|
| FIG. 4 | Fully exhausted | V3 | V1 |
| FIG. 5 | Fully exhausted | Fully exhausted | V2 |
| FIG. 6 | V1 | Fully exhausted | V3 |
| FIG. 7 | V2 | Fully exhausted | Fully exhausted |
| FIG. 8 | V3 | V1 | Fully exhausted |
| FIG. 9 | Fully exhausted | V2 | Fully exhausted |
| FIG. 10 | Fully exhausted | V3 | V1 |
| FIG. 11 | Fully exhausted | Fully exhausted | V2 |
| FIG. 12 | V1 | Fully exhausted | V3 |
| FIG. 13 | V2 | Fully exhausted | Fully exhausted |
| FIG. 14 | V3 | V1 | Fully exhausted |
| FIG. 15 | Fully exhausted | V2 | Fully exhausted |

It is appreciated from studying of the above-chart that there are six power cycles per revolution of the rotor 60 within the housing 20.

As means of an example only, at V2, the volume can be 1 unit and the pressure 4 units. Then, at V3, the volume can be 4 units and the pressure 1 unit. Likewise, the pressure external of the expansion chamber is 1 unit. In this regard, the pressure inside and outside of the expansion chamber are equal at V3. The timing of the opening and closing of the input valves is determined by the processor whereby this result is achieved.

Figure 16B:
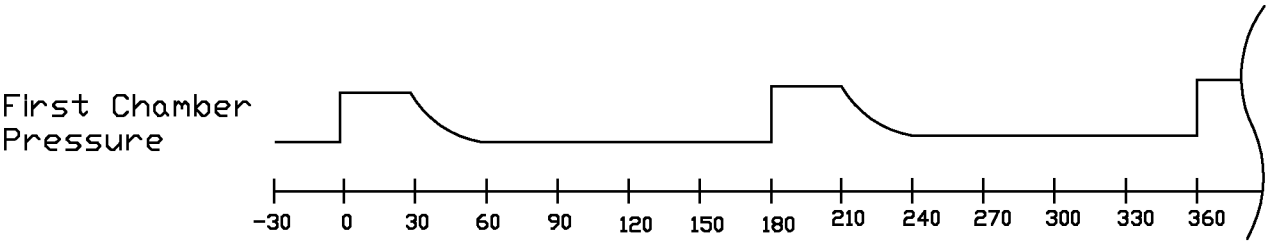
FIG. 16B is a chart showing pressure within an expansion chamber as apex A moves around the housing.

FIG. 16B shows graphically pressure within the first chamber as a function of the location of apex A 70 relative the housing (in degrees of rotation).

Figure 16C:
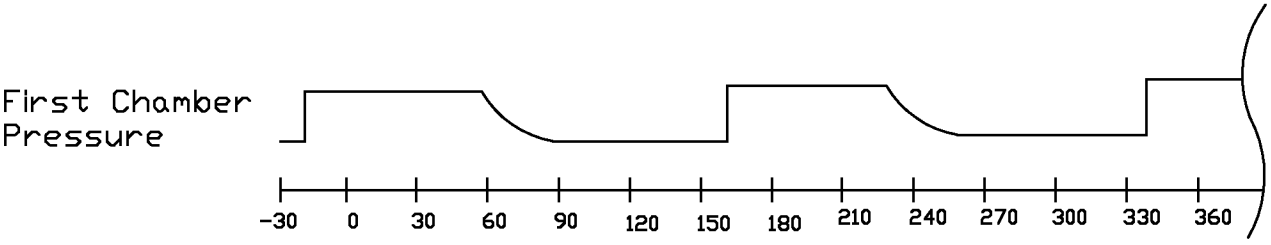
FIG. 16C is similar to FIG. 16B, but shows an increased pressure throughout the revolution of apex A.

FIG. 16C shows graphically the pressure within the first chamber as a function of the location of apex A 70 with an elongated driving force due to 1) opening the valve approximately 20 degrees earlier and closing approximately 20 degrees later. Both early opening and late closing are allowed by the gate.

Figure 19:
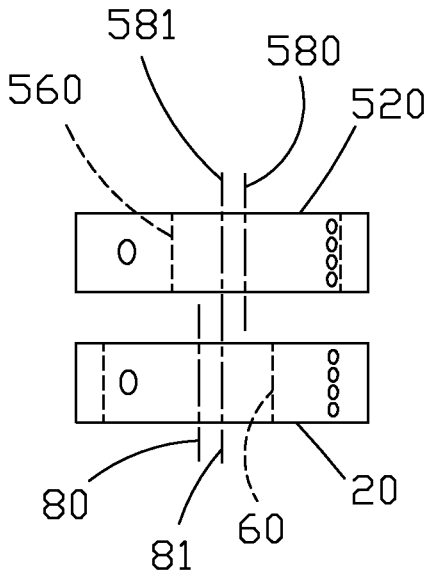
FIG. 19 is similar to FIG. 18, but shows two housings with rotors in opposed positions.
Figure 20:
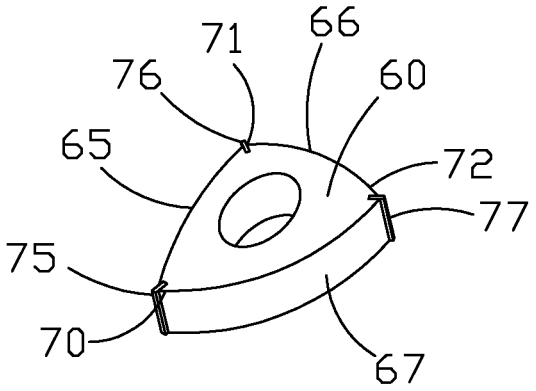
FIG. 20 is an isolation perspective view of a rotor showing smooth rotor faces.

Turning now to FIG. 19, it is seen that a second housing 520 and rotor 560 can be provided. The rotor 560 has a center point 580 and the housing has fulcrum 581. The housing 520 is preferably oriented similarly as housing 20. In this regard, the respective rotors are offset from each other, which allows an engine with two housings to drive an offset crankshaft.

Figure 28:
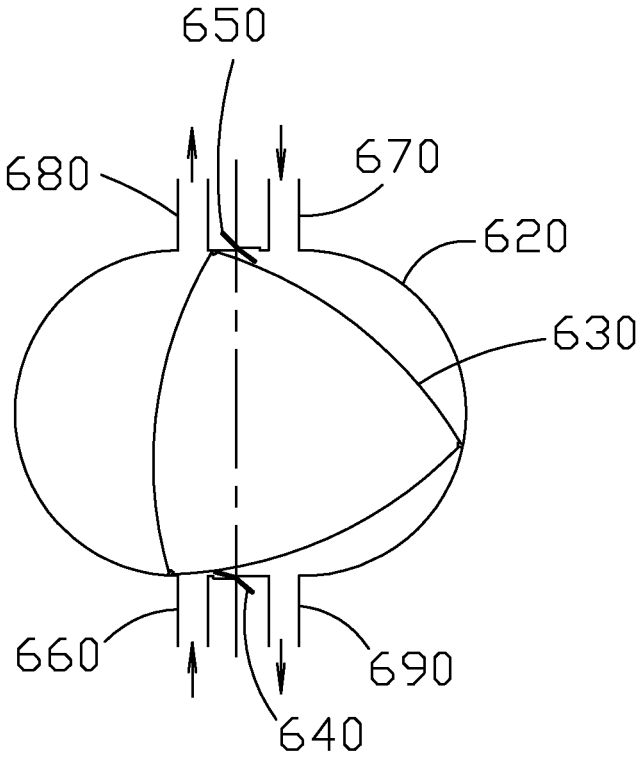
FIG. 28 is a schematic view showing alternative inlet and exhaust locations.

Turning now to FIG. 28, it is seen that a housing 620 is provided. The housing 620 has a rotor 630 and gates 640 and 650. The gates allow inlets 660 and 670 and outlets 680 and 690 to be located at alternative locations about the perimeter of the housing 620. In particular, the gates and alternative exhaust locations allow for larger exhaust volumes, which in turn allow for elongated driving forces to be applied (high pressure applied longer in the cycle so that exhaust pressures are equal).

Also, the gates allow the exhaust to be much closer to the next successive inlet, as the gate prevents back-flowing within an expansion chamber as it bifurcates the expansion chamber. The inlet valves can also be opened earlier in the cycle thereby elongating the driving force. In this regard, in an embodiment without a valve, the inlet valve can be opened with the trailing apex passes the exhaust port. However, when a gate is provided, there is no way for the gas to reach the exhaust port and the valve can be opened before the trailing apex passes the exhaust port.

Figure 21:
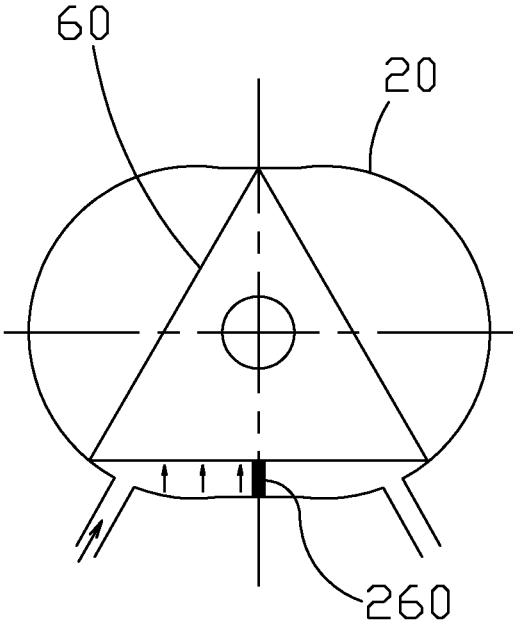
FIG. 21 shows pressure being applied to ½ of the rotor, wherein an expansion chamber is bisected by a gate.

Looking now at FIG. 21, it is seen that if an equilateral triangle were centered within the housing, that it would be equidistant between the inlet and outlet. Further, a center line from the top apex of the triangle to the center point of the base would pass directly through the fulcrum of the housing. If there was no gate, adding pressure at this point in rotation would lead to a locked rotor (equal pressure on each side of the fulcrum) The solutions to this problem are either 1) retarding the input until the trailing apex passes the outlet or 2) adding the gate to block gas and hence pressure from being able to act on the triangle behind the gate. Hence, all of the pressure acts on the first side of the triangle which applies a force to move the triangle in clockwise orientation.

It is appreciated that the engine 10 of the present invention is able to power many types of devices. Two examples are as an automobile engine and as a means to extract energy out of an existing heating system such as a building heating system.

One typical building heating system is a furnace. In this regard, the current furnace simply burns fuel and uses the waste heat to warm a building. By installing a heat engine, the fuel would still be burned, but the heat energy from said burning is used to propel the heat engine, such as the heat engine of the present invention, which can be used to generate electric power via generator.

The waste heat contained in the gas exiting the exhausts is still routed through the condensation chamber 180. Yet, heat exchanger 185 can be used to draw heat from the condensation chamber 180 and transfer it to a building via the building HVAC system. In this regard, the heat of the exhaust gas is not lost, and not dissipated generally. Instead, the dissipated heat is redirected to the building to fulfill the environmental requests of the HVAC system.

Another embodiment is illustrated in FIGS. 29-61.

Figure 29:
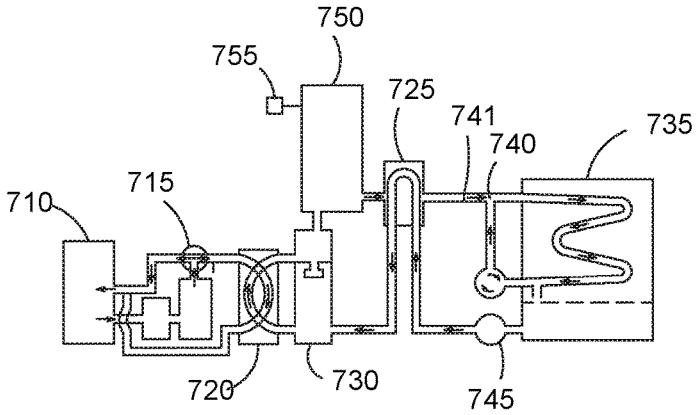
FIG. 29 is a layout view of an additional embodiment of an engine and other components.

Looking first at FIG. 29, it is seen that a boiler 710 is provided. The boiler can heat a liquid and force it through a two way valve 715. On one side of the valve, the fluid is rerouted to the boiler (when it is not needed) and on the other side of the valve, the fluid is routed to a heat exchanger 720 before being returned to the boiler. Reservoir 730 has a refrigerant therein. The reservoir pipes fluid to the heat exchanger 720 wherein it evaporates and forms a high pressure gas. The high pressure gas is used to drive the engine 750, as described below. The gas leaves the engine and passes through a heat exchanger 725 prior to entering a condenser 735. Any gas that does not evaporate can pass through a 1-way return valve 740 to cycle back through the condenser an additional time. A second 1-way valve 741 is provided to prevent backflow into the engine 750. A pump 745 is provided to return condensed liquid back through the heat exchanger 725 and to the reservoir 730.

A valve is shown generically in FIG. 55. In this figure, it is seen that the valve has an inlet and an exhaust. A gate, wall or other structure could be utilized to allow gas to enter or leave via the appropriate path.

It is appreciated that while these above-mentioned components are shown and described, that alternatives and substitutions may be made without departing from the broad aspects of the present invention, and specifically the broad aspects of the engine 750 as it is described below.

Figure 56:
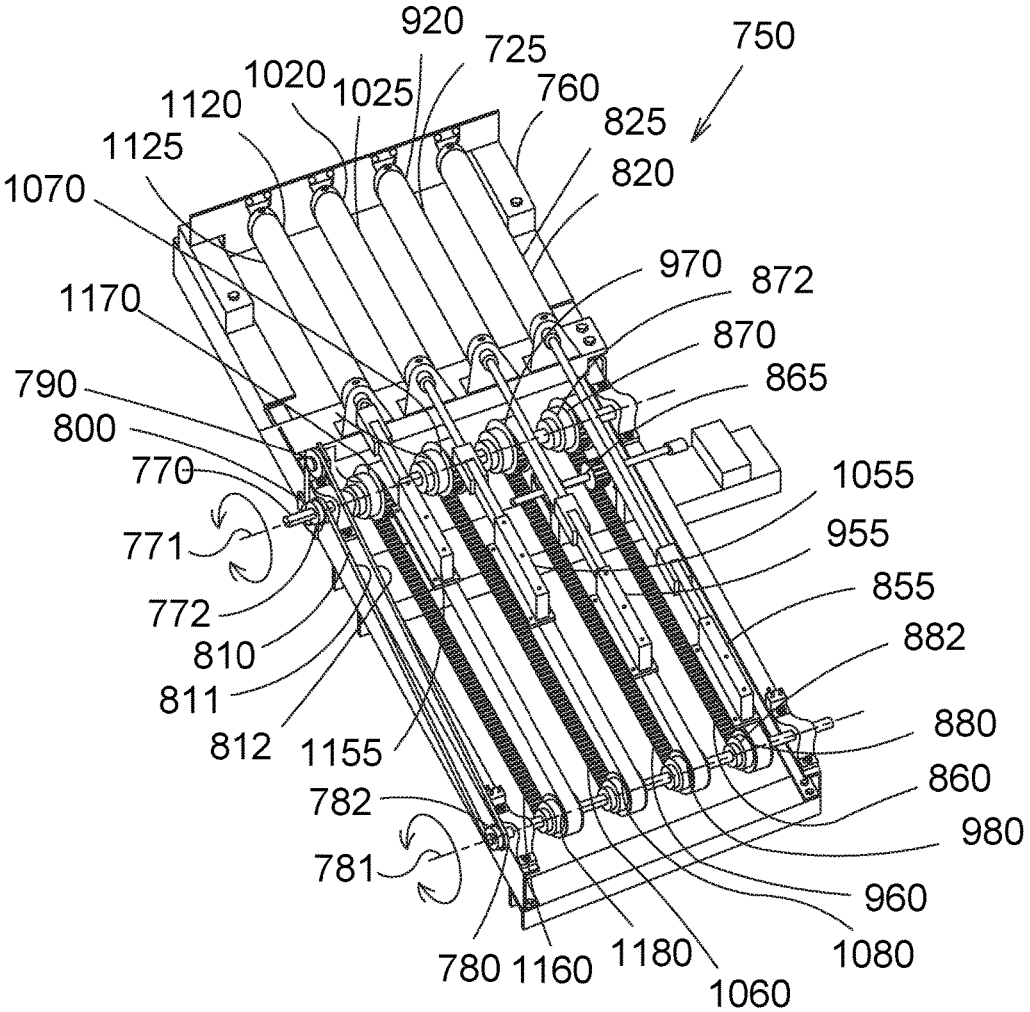
FIG. 56 is a perspective view of a preferred embodiment of the present invention.

Turning now to FIG. 56, it is seen that an engine 750 is provided. Engine 750 has a base 760, two shafts 770 and 780 and respective gears 772 and 782, position gears 790 and 800 positioning a chain 810 and a plurality of actuators 820, 920, 1020 and 1120 each with associated gears. It is understood that while four actuators are shown, that more or fewer may be used without departing from the broad aspects of the present invention. Specifically, the engine could work with a single actuator, yet, in the preferred embodiment, several actuators are utilized in order to flatten or normalize the engine power output. It is also preferred that, as described below, that the actuators are double acting actuators. Yet, the principles of the present invention could be utilized using single acting actuators without departing from the broad aspects of the present invention.

Each of these components is described below in detail. A processor 755 is provided and is not described in detail below. However, the processor controls the opening and closing of the valves.

Base 760 is shown in FIG. 56. The base can be made of any suitable material that is strong and durable enough to support the components of the system.

Figure 30:
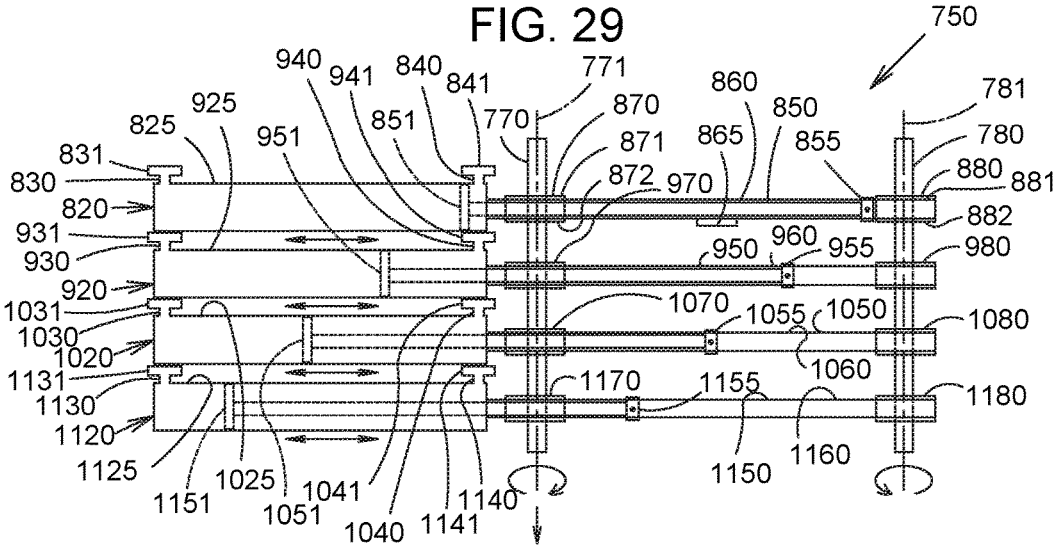
FIG. 30 is a top view showing several working parts of the engine of the present invention.
Figure 31:
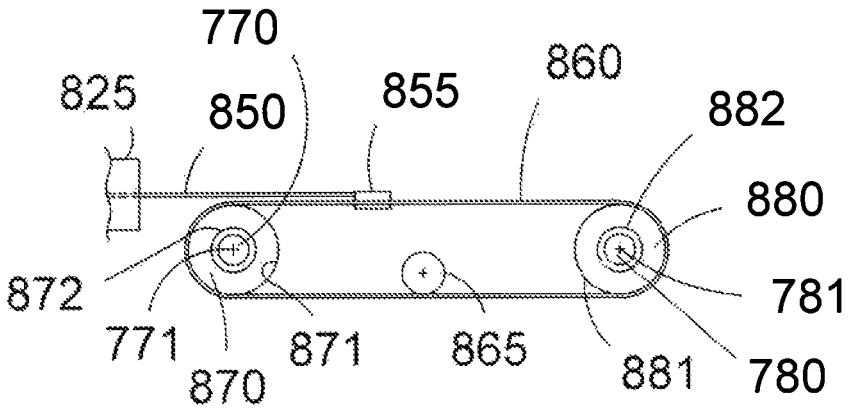
FIG. 31 is a side view showing shafts coupled to a belt.
Figure 32:
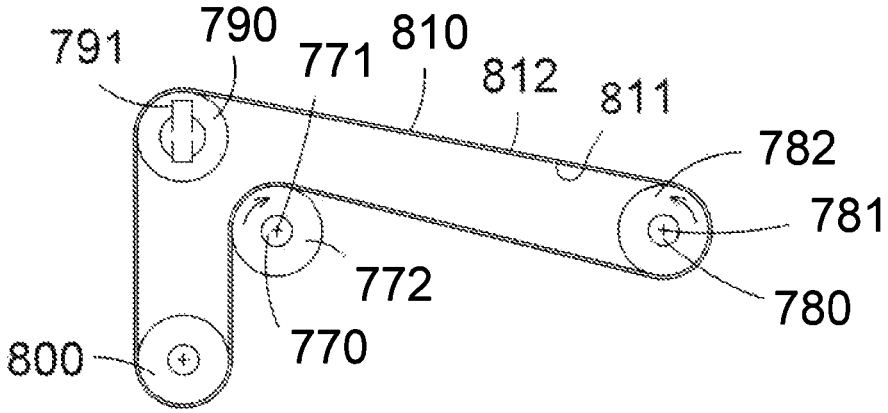
FIG. 32 is a side view showing a chain coupling the shafts.
Figure 33A:
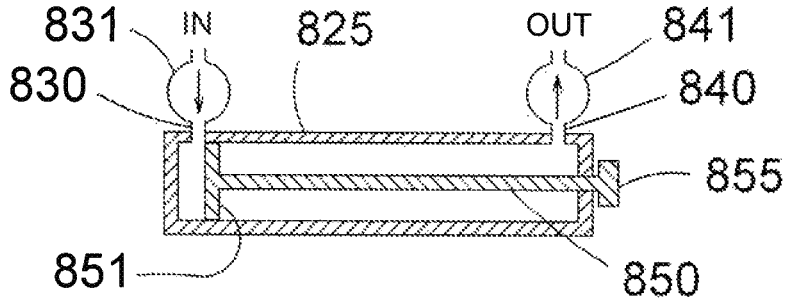
FIG. 33A is a side view of an actuator showing a first valve in an open position in the extension stroke and the second valve in the open position to exhaust gas from behind the actuator head.
Figure 33B:
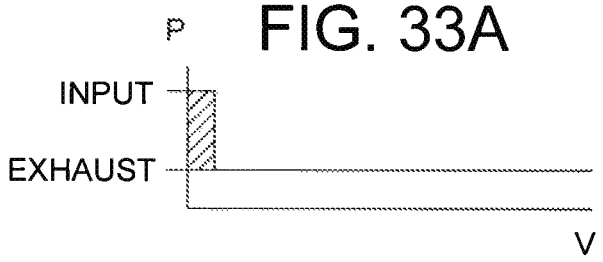
FIG. 33B is a chart showing the pressure within the actuator shown in FIG. 33A.
Figure 34A:
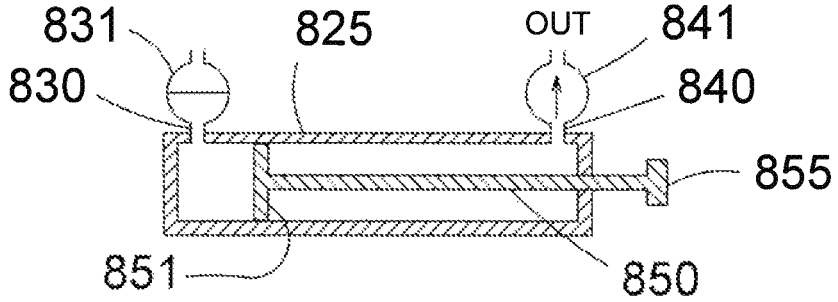
FIG. 34A is a side view of the actuator shown in FIG. 33A but showing the first valve in the closed position in the extension stroke and the second valve in the open position to exhaust gas from behind the actuator head.
Figure 34B:
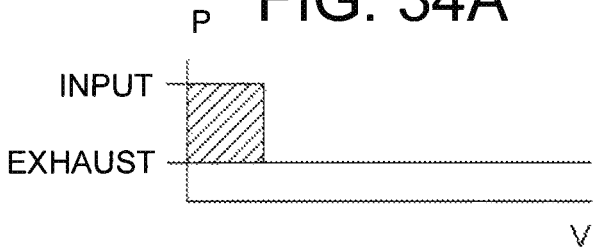
FIG. 34B is a chart showing the pressure within the actuator shown in FIG. 34A.
Figure 35A:
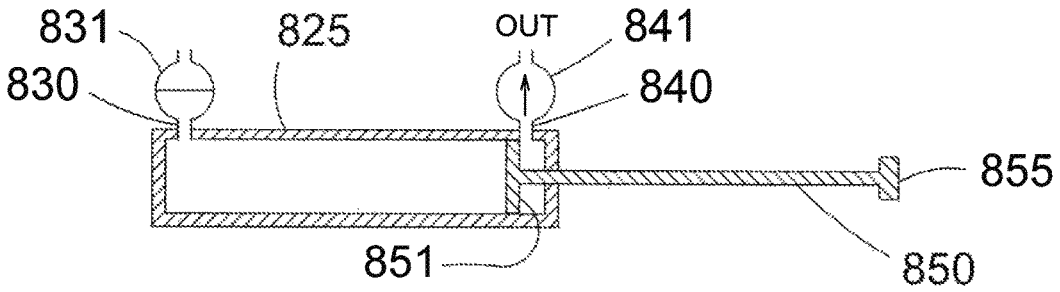
FIG. 35A is a side view of the actuator shown in FIG. 33A but showing the first valve in the closed position at the end of the extension stroke and the second valve in the open position to exhaust gas from behind the actuator head.
Figure 35B:
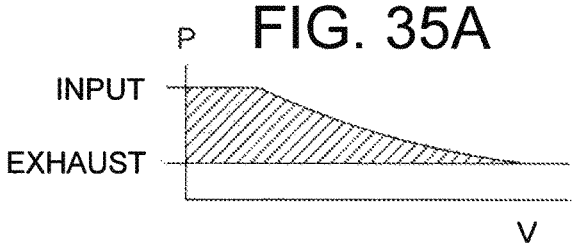
FIG. 35B is a chart showing the pressure within the actuator shown in FIG. 35A.
Figure 36A:
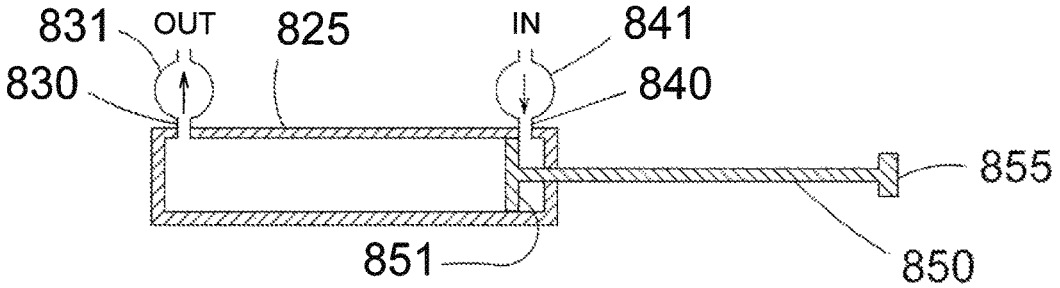
FIG. 36A is a side view of an actuator showing the second valve in an open position in the return stroke and the first valve in the open position to exhaust gas from behind the actuator head.
Figure 36B:
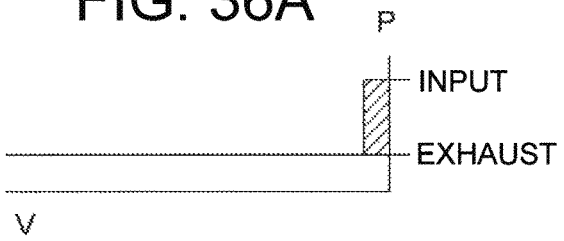
FIG. 36B is a chart showing the pressure within the actuator shown in FIG. 36A.
Figure 37A:
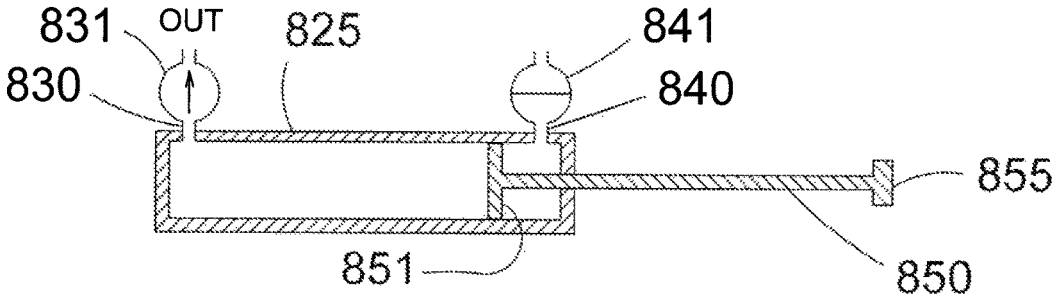
FIG. 37A is a side view of the actuator shown in FIG. 36A but showing the second valve in the closed position in the return stroke and the first valve in the open position to exhaust gas from behind the actuator head.
Figure 37B:
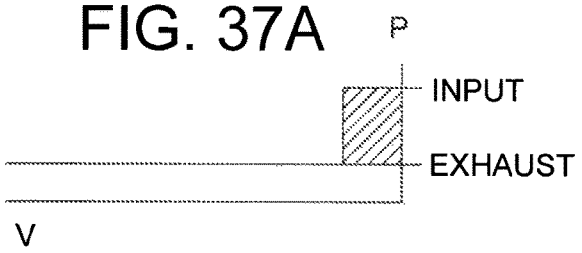
FIG. 37B is a chart showing the pressure within the actuator shown in FIG. 37A.
Figure 38A:
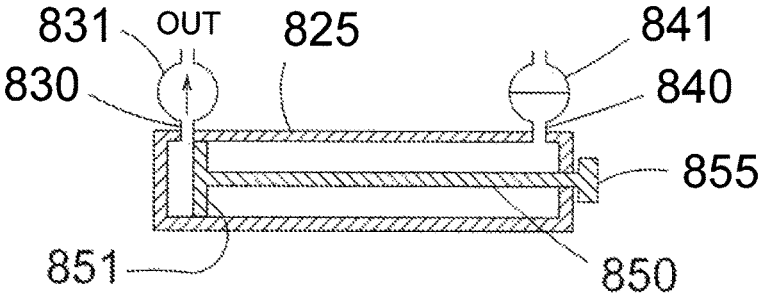
FIG. 38A is a side view of the actuator shown in FIG. 36A but showing the second valve in the closed position at the end of the return stroke and the first valve in the open position to exhaust gas from behind the actuator head.
Figure 38B:
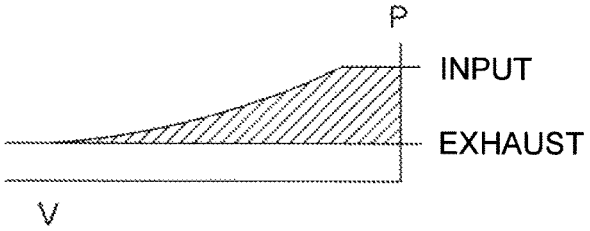
FIG. 38B is a chart showing the pressure within the actuator shown in FIG. 38A.
Figure 39:
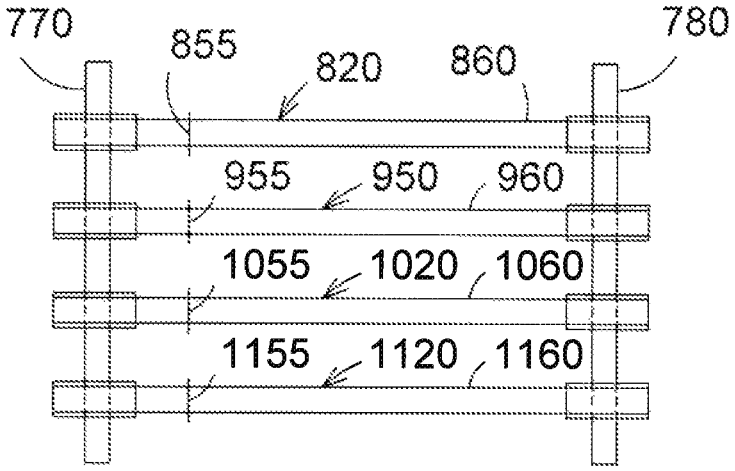
FIG. 39 is a schematic view showing the positions of the actuators at the neutral position.
Figure 40:
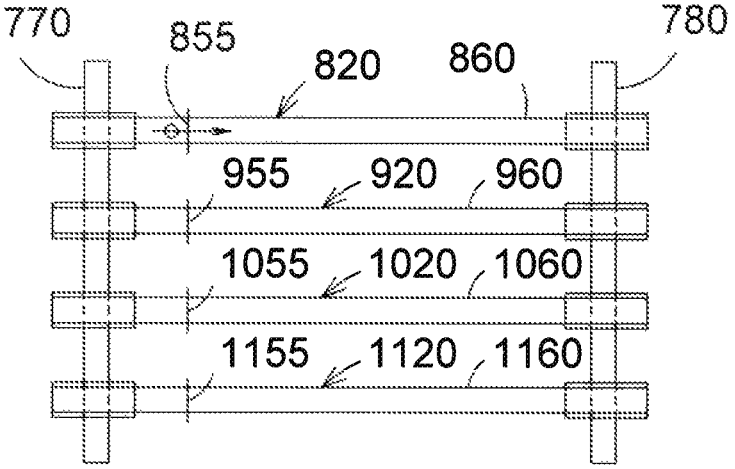
FIG. 40 is similar to FIG. 39, but shows the first actuator being energized in the extension stroke.
Figure 41:
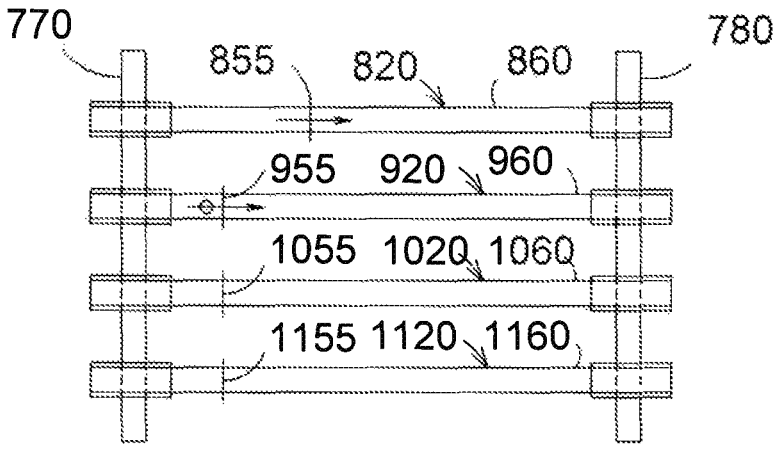
FIG. 41 is similar to FIG. 40, but shows the second actuator being energized in the extension stroke.
Figure 42:
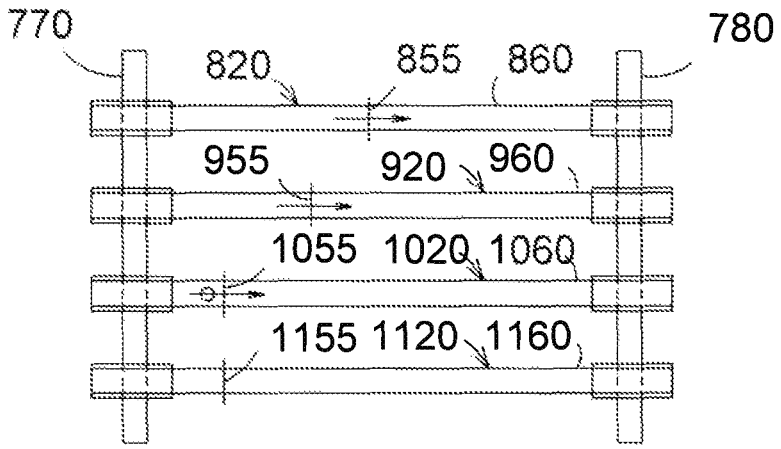
FIG. 42 is similar to FIG. 41, but shows the third actuator being energized in the extension stroke.
Figure 43:
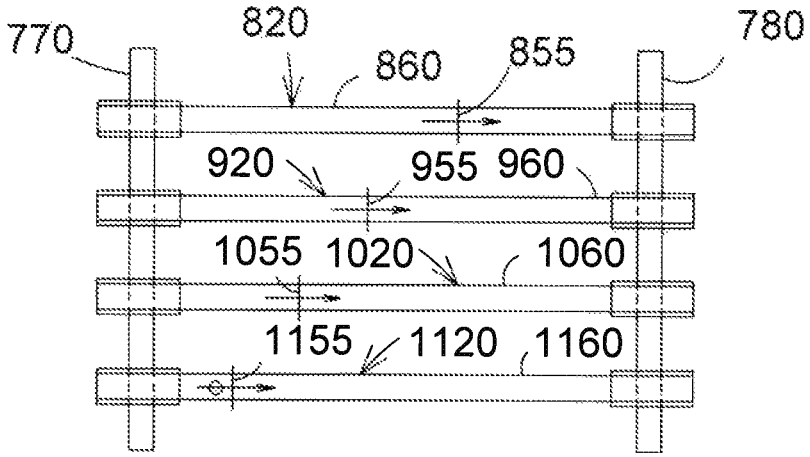
FIG. 43 is similar to FIG. 42, but shows the fourth actuator being energized in the extension stroke.
Figure 44:
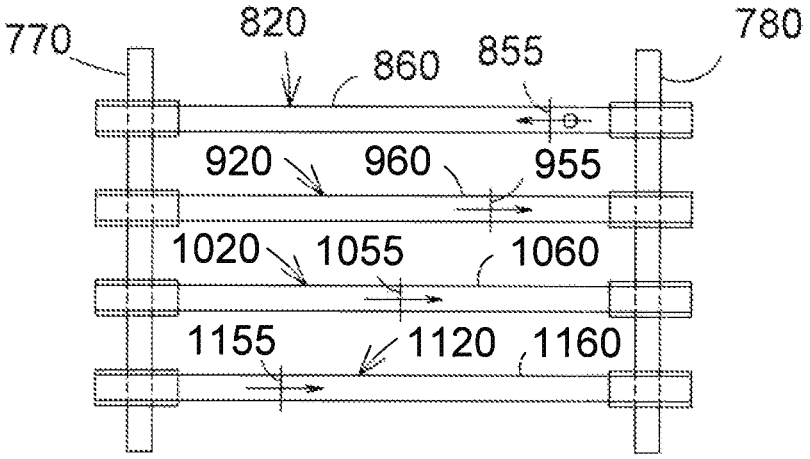
FIG. 44 is similar to FIG. 43, but shows the first actuator being energized in the return stroke.
Figure 45:
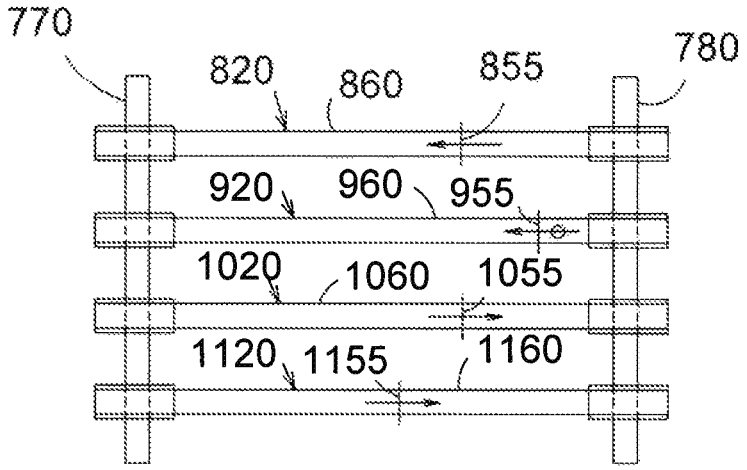
FIG. 45 is similar to FIG. 44, but shows the second actuator being energized in the return stroke.
Figure 46:
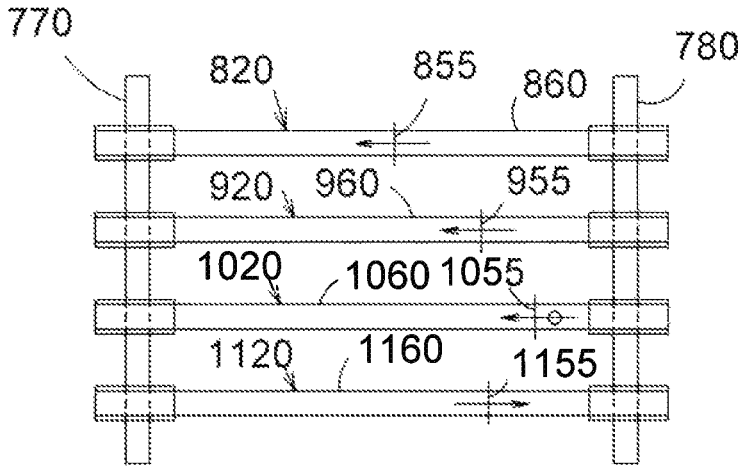
FIG. 46 is similar to FIG. 45, but shows the third actuator being energized in the return stroke.
Figure 47:
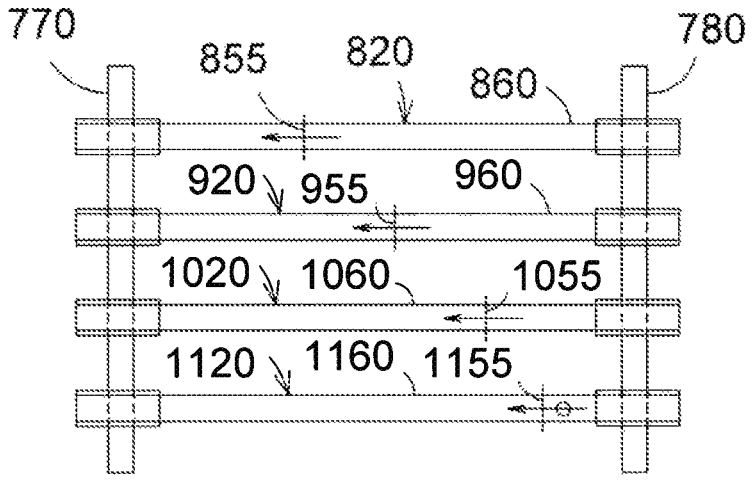
FIG. 47 is similar to FIG. 46, but shows the fourth actuator being energized in the return stroke.
Figure 48:
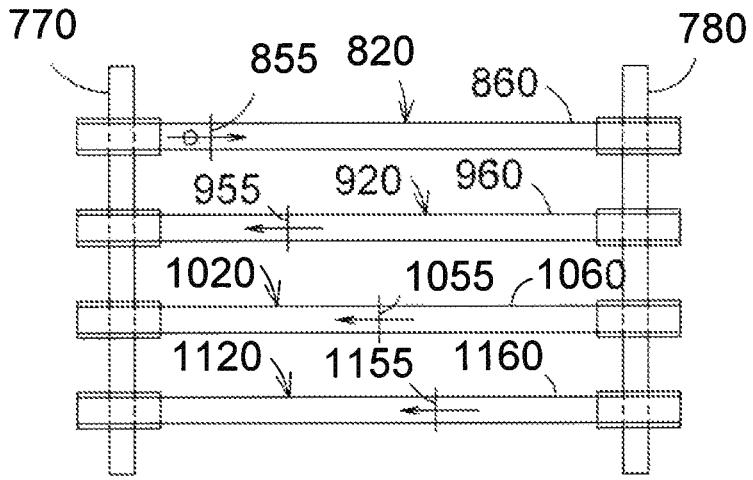
FIG. 48 is similar to FIG. 47, but shows the first actuator being energized in the extension stroke.
Figure 49:
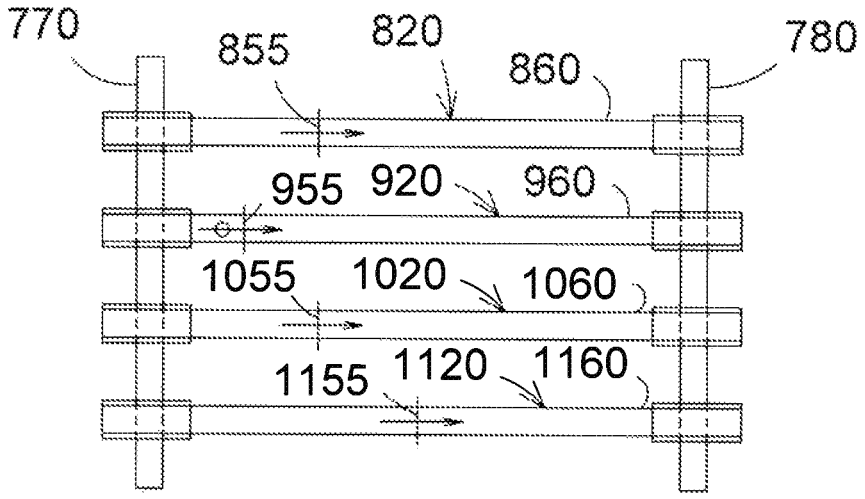
FIG. 49 is similar to FIG. 48, but shows the second actuator being energized in the extension stroke.
Figure 50:
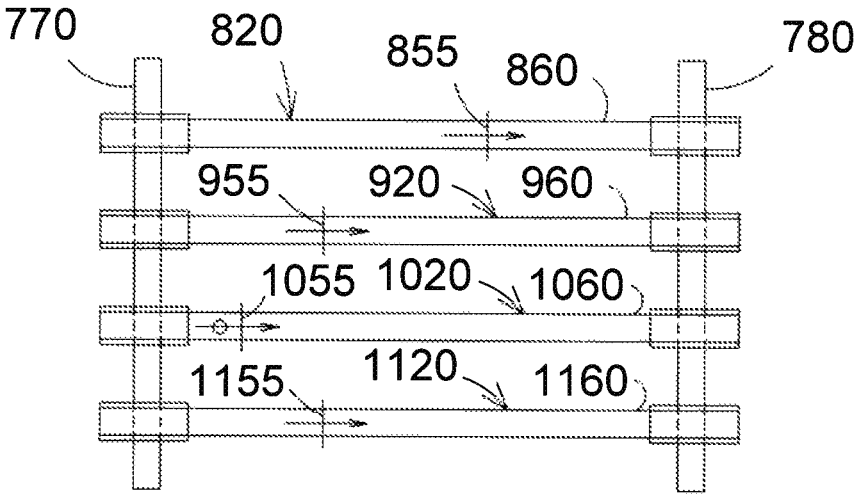
FIG. 50 is similar to FIG. 49, but shows the third actuator being energized in the extension stroke.
Figure 51:
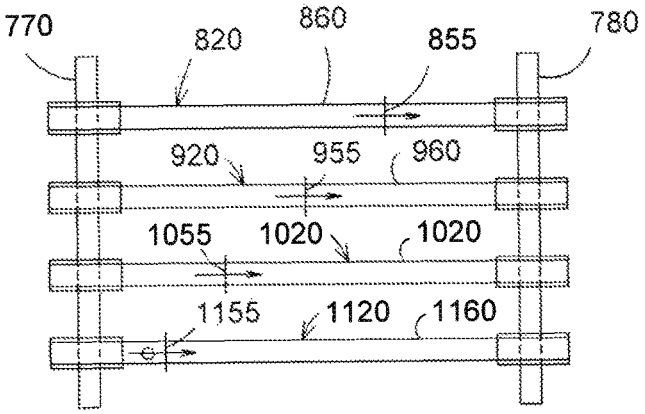
FIG. 51 is similar to FIG. 50, but shows the fourth actuator being energized in the extension stroke.

Turning now to FIGS. 30-32, it is seen that a shaft 770 is provided and is supported by the base 760. Shaft 770 has two ends and is rotatable about an axis of rotation 771. A gear 772 is at the second end of the shaft 770. The gear 772 is preferably fixed to the shaft 770 such that the rotation of the shaft causes the gear to rotate in a likewise manner. Shaft 770 can be connected to an additional device to harness energy from the shaft as it rotates. In this regard, shaft 770 is a drive shaft.

A second shaft 780 is also provided. The second shaft 780 has two ends and is rotatable about an axis of rotation 781. A gear 782 is at the second end of the shaft 780. The gear 782 is preferably fixed to the shaft 780 such that the rotation of the shaft causes the gear to rotate in a likewise manner.

Shafts 770 and 780 are preferably parallel to each other. In this regard, the axis of rotation 771 of shaft 770 is parallel to but offset from the axis of rotation 781 of shaft 780.

A positioning gear 790 and a positioning gear 800 are also provided and are supported by the base 760. Gear 800 is preferably fixed relative the base 760. However, a slot 791 is provided so that gear 790 is adjustable supported relative the base. The slot is preferably oriented towards and away from the center of the second positioning gear 800 so that the first and second positioning gears 790 and 800 can be moved closer to and further away from each other to provide tension to the chain.

A chain 810 having an inside 811 and an outside 812 is further provided, and is best seen in FIG. 32. The chain 810 wraps around gear 772, gear 782, position gear 790 and position gear 800. Specifically, the inside 811 of chain wraps around gear 782, 790 and 800. The outside 812 of chain 810 wraps around gear 772. It is preferred that there is at least ¼ turn of contact between the chain and the gears to avoid putting too much pressure on the gear teeth. It is appreciated that chain 810 operatively couples shafts 770 and 780. Shaft 770 preferably always rotates in a single rotational direction. Rotational force from the second shaft 780 is transferred in an inverted manner to the first shaft 770 due to the inversion of the chain 810.

Looking now at FIG. 30, it is seen that in the preferred embodiment, four actuators 820, 920, 1020 and 1120 are provided. Each actuator is preferably similar or identical. One actuator 820 is described in detail below. It is understood that the other actuators are similar or identical to the actuator described below. The actuators generally are linear gas powered actuators that are dual power or two way operational actuators. In this regard, the actuators are powered in the extension stroke as well as the return or retraction stroke.

Actuator 820 has a cylinder 825. The cylinder 825 has two ends. A port 830 operable with a valve 831 is at the first end. A port 840 operable with a valve 841 is at the second end. Valves 831 and 841 can be selectably opened and closed to allow high pressure gas to enter the cylinder and drive a rod 850 by acting on a selected side of a head or boss 851. In this regard, when pressure is introduced on the first side of the head 851 the rod extends, and when pressure is introduced on the second side of the head, the rod retracts. A clamp 855 is provided on the outer end of the rod 850. The clamp 855 is used to connect the rod to a belt 860.

A position sensor 865 is provided and communicates the location of the belt 860 to a controller. In this regard, the timing of the actuator 820 can be monitored and maintained. Position sensor 865 fits within the grooves on the inside portion of the bottom of the belt. Sensor 865 communicates with an encoder to determine the position of the head of the actuator and communicates the information to the processor 755.

A gear 870 with a perimeter 871 is provided. The gear has a clutch bearing 872. Clutch bearing 872 is preferably a one-way clutch bearing that is press fit securely within gear 870. Gear 870 is attached to shaft 770. The gear, via the clutch bearing 872, locks in one direction wherein it will cause the shaft to rotate, yet turns freely in the opposite direction without imparting a force onto the shaft.

A second gear 880 also with a perimeter 881 and a clutch bearing 882 is provided. Gear 880 is attached to shaft 780. The second gear is similar in operation to the first gear.

Belt 860 is preferably wrapped about gears 870 and 880. The belt rotates in a first direction about gears 870 and 880 when the rod 850 is extending from the cylinder 825. The belt rotates in the opposite direction about gears 870 and 880 when the rod is retracting into the cylinder 825. Clutch bearings 872 and 882 are 1-way clutch bearings. In this regard, the bearings can affect rotation of respective shafts in one direction yet freely rotate about the respective shaft when rotating in the opposite direction. Specifically, during the extension phase, gear 870 causes shaft 770 to rotate while gear 880 is not engaged with shaft 780. Yet, during the retraction or return phase, gear 880 engages and causes shaft 780 to rotate while gear 870 is disengaged with shaft 770.

Looking now to FIGS. 33A-38B, the sequence of opening and closing the valves (and the associated pressures within the cylinder) are provided. In the extension stroke, valve 841 is open the entire time so that back pressure does not build up behind head 851. Valve 831 opens at the start of the extension (FIG. 33A) and remains open until a point (an intermediate point) where it closes when the head is between the ends (FIG. 34A). The first valve 831 then remains closed as the rod becomes fully extended (FIG. 35A). The pressure inside the cylinder 825 is charted in FIGS. 33B-35B during the extension stroke.

The return or retracted stroke is illustrated in FIGS. 36A-38B. Valve 831 remains open during the entire return stroke so that pressure does not build up behind the head 851. Valve 841 opens at the start of the retraction (FIG. 36A) and remains open until a point (an intermediate point) where it closes when the head is between the ends (FIG. 37A). The first valve 841 then remains closed as the rod becomes fully returned or retracted (FIG. 38A). The pressure inside the cylinder 825 is charted in FIGS. 36B-38B during the return stroke.

The closing of the valves is preferably determined to be to point where the pressure inside and outside of the cylinder are equal at the end of the stroke.

The closing of the valves is driven by a processor 755 that interprets the following formula: $P1 \times V1 = P2 \times V2$. Where:

P1=High pressure on the input side of the engine.

V1=The volume within the driving side of actuator when input valve closes.

P2=Low pressure on the Exhaust side of the engine.

V2=The full volume within the driving side of the actuator when the stroke is completed.

Figure 52:
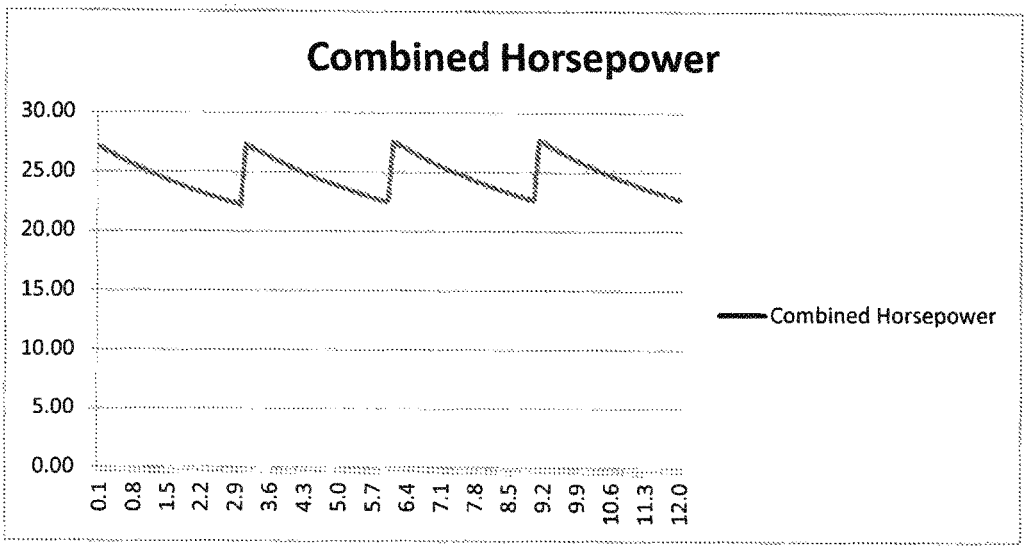
FIG. 52 is a chart showing combined horsepower during the extension stroke of the first actuator and the other actuators at corresponding positions.

FIG. 54 illustrates a specific set of preferred manufacturing parameters regarding the actuators. It is understood that this data is illustrative only and that pressures, dimensions and other parameters may vary without departing from the broad aspects of the present invention. In this example, the input valve is opened longer than necessary as is evidenced in a higher horsepower output. FIGS. 52 and 53 show the engine output yielded by such parameters. However, the higher horsepower is achieved with lowered efficiency. Specifically, a relatively high input pressure times volume product is provided at the point where the valve closes. Then, right before the end of the stroke, more than necessary pressure remains in the actuator representing potential energy that is not harvested by the engine.

Looking now to FIGS. 57A to 61, it is seen that a more preferred embodiment of parameters (FIG. 61) is illustrated. FIGS. 57A to 58B illustrate the output of a single actuator during its extension and retraction strokes, respectively. As is seen, the horsepower goes to zero at the end of the stroke as the last of the potential energy of the expanding gas is utilized. The pressure within the actuator is approximately the same as the pressure outside of the actuator at the end of the stroke as shown in this example. The efficiency of harvesting potential energy is maximized when the pressure within the actuator is approximately the same as the pressure outside of the actuator at the end of the stroke. FIG. 59 shows the combined horsepower of four actuators operating in offset phase to achieve the cumulative output illustrated in the graph of FIG. 60.

The second, third and fourth actuators are similar to the first actuator, and are briefly described below. Then, following this brief description, independent operation of the four actuators is shown and described.

Actuator 920 has a cylinder 925 with two ends. A port 930 with a valve 931 is at the first end, and a port 940 with a valve 941 is at the second end. A rod 950 with a head 951 can be extended from and retracted into the cylinder 925 under operation of the valves. A clamp 955 connects the end of the rod 950 to a belt 960. The belt 960 operates gears 970 and 980 driving shafts 770 and 780, respectively.

Actuator 1020 has a cylinder 1025 with two ends. A port 1030 with a valve 1031 is at the first end, and a port 1040 with a valve 1041 is at the second end. A rod 1050 with a head 1051 can be extended from and retracted into the cylinder 1025 under operation of the valves. A clamp 1055 connects the end of the rod 1050 to a belt 1060. The belt 1060 operates gears 1070 and 1080 driving shafts 770 and 780, respectively.

Actuator 1120 has a cylinder 1125 with two ends. A port 1130 with a valve 1131 is at the first end, and a port 1140 with a valve 1141 is at the second end. A rod 1150 with a head 1151 can be extended from and retracted into the cylinder 1125 under operation of the valves. A clamp 1155 connects the end of the rod 1150 to a belt 1160. The belt 1160 operates gears 1170 and 1180 driving shafts 770 and 780, respectively.

Turning now to FIGS. 39-51, the advancement and retraction of the various actuators is illustrated. It is appreciated that the actuators 820, 920, 1020 and 1120 have an offset phase. In this regard, each actuator is offset by ¼ stroke. The offset is preferably determined as the inverse of the number of actuators whereby the output power generation curve is leveled off to reduce spikes and dips in power. Being offset in phase is determined by when each actuator is energized (in both the positive or extension stroke and the negative or retraction stroke) and accordingly the distance each actuator is offset. Hence it is illustrated that the actuators are independently energized and operate independent of each other in offset phases. The actuators can accordingly be in relative different positions relative to their respective stoke distances or operate in different directions (positive or negative stroke) as they are independent of each other. Yet, the output forces are cumulative. The offset timing and cumulative output continue during each cycle of operation of the engine.

The actuators apply positive force to shaft 770 during the extension stroke and apply positive force to shaft 780 during the return stroke. The forces applied are cumulative to the pressure within the respective cylinder.

It is appreciated that the rotational force of the shafts 770 and 780 is perpendicular to the extension and retraction force of the actuators. The belts driven by the respective actuators are preferably offset from the center of the shafts by about 2.25 inches. Of course, the offset can vary depending on the size of the cylinders and other components. The preferred (but not limited) offset is between 1 and 12 inches. Yet, this amount could be more or less without departing from the other aspects of the present invention.

Rotational energy from shaft 770 can be used for any number of purposes, including being connected to a generator to produce electricity.

Given the operable connection between the shafts and the use of 1-way clutches, it is appreciated that the force of the actuators is cumulative from the engine 750. The force output in one embodiment is shown in chart and data form in FIGS. 52 and 53 and in another embodiment in FIGS. 59 and 60. Noteworthy, due to the diameter of the rod (and specifically its displacement) acting on the back side of the rod head in the return stroke, the pressure time volume product on the return stroke is less than the pressure times volume product on the extension stroke due to the volume occupied by the rod. To account for this, it is understood that the closing timing on the return stroke may vary from the closing timing on the extension stroke without departing from the broad aspects of the present invention.

It is thus seen that the actuators independently follow the formula P1 times V1 equals P2 times V2 in harvesting potential energy from the actuator. The output from each actuator is cumulative with the output of the other actuators.

Thus it is apparent that there has been provided, in accordance with the invention, a heat engine such as a linear drive heat engine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A heat engine comprising:

an actuator, said actuator being a double acting actuator and is operable with a first clutch and a second clutch;

a first shaft operable in a first direction;

a second shaft; and a chain operably coupling said first shaft and said second shaft and not being directly connected to said actuator; wherein:

said first clutch is operable relative said first shaft and is a one way clutch, said first clutch causing said first shaft to turn in the first direction;

said second clutch is operable relative said second shaft and is a one way clutch, said second clutch causing said second shaft to turn in a second direction that is opposite of said first direction; and said chain moves in one rotational direction and transfers force from said second shaft turning in said second direction to said first shaft causing said first shaft to rotate in said first direction.

2. The heat engine of claim 1, wherein said chain is a continuous loop chain and has an inside and an outside;

wherein:

said inside of said chain engages said second shaft; and said outside of said chain engages said first shaft.

3. The heat engine of claim 2 further comprising a first position gear and a second position gear;

wherein said inside of said chain engages said first position gear and said second position gear; and wherein said first position gear is adjustable relative to a slot;

whereby a position of said first position gear relative to said slot determines an amount of tension force applied to said chain.

4. The heat engine of claim 1, wherein said actuator is a first actuator, said heat engine further comprising a second actuator, a third actuator and a fourth actuator;

wherein each of said first actuator, said second actuator, said third actuator and said fourth actuator independently operate upon said first shaft and said second shaft.

5. The heat engine of claim 1, wherein:

said actuator has a head movable between a first end position at an actuator first end, a between position and a second end position at an actuator second end;

said actuator further comprises an input valve, said input valve being open from when said head is in said first end position until said head is in said between position;

when said head is in said between position, said actuator has a between volume and a between pressure; and when said head is in said second end position, said actuator has a second end pressure and a second end volume, said second end pressure being equal to an ambient pressure when said first actuator is opened to the ambient pressure.

6. A heat engine utilizing heat to create a high pressure gas, said heat engine comprising:

a first actuator, said first actuator being a double acting actuator and having a first actuator stroke length, said first actuator having a decreasing power output after a first actuator valve closes and as a first amount of the high pressure gas expands within said first actuator to move a first actuator head;

a second actuator, said second actuator being a double acting actuator and having a second actuator stroke length, said second actuator having a decreasing power output after a second actuator valve closes and as a second amount of the high pressure gas expands within said second actuator to move a second actuator head;

a first shaft; and a second shaft;

wherein:

said first actuator is coupled to said first shaft and to said second shaft;

said second actuator is coupled to said first shaft and to said second shaft;

said first shaft turns in a single rotational direction;

said first actuator is operable independent of said second actuator to turn said first shaft in the single rotational direction; and said first actuator is operable in an offset phase relative to said second actuator.

7. The heat engine of claim 6, wherein:

said first actuator has a continuously sized diameter along said first actuator stroke length and said first actuator head is movable between a first end position, a between position and a second end position;

when said first actuator head is in said between position, said first actuator valve closes and said first actuator has a between volume and a between pressure; and when said first actuator head is in said second end position, said first actuator has a second end pressure and a second end volume, said second end pressure being equal to an ambient pressure when said first actuator is opened to the ambient pressure.

8. The heat engine of claim 6 further comprising a third actuator and a fourth actuator.

9. The heat engine of claim 6, wherein:

said first actuator has a first actuator stroke distance;

said first actuator and said second actuator are part of a number of actuators; and said first actuator has an offset timing from said second actuator whereby said first actuator is offset from said second actuator by a distance equal to said first actuator stroke distance divided by said number of actuators.

10. A heat engine utilizing heat to create a high pressure gas, said heat engine comprising:

a first actuator with a first actuator interior length and having a constant first actuator diameter along said first actuator interior length, said first actuator being a double acting actuator, and being operable with a first actuator first clutch and a first actuator second clutch, said first actuator being operable by expansion of the high pressure gas against a first actuator head;

a second actuator with a second actuator interior length and having a constant second actuator diameter along said second actuator interior length, said second actuator being a double acting actuator, and being operable with a second actuator first clutch and a second actuator second clutch, said second actuator being operable by expansion of the high pressure gas against a second actuator head;

a first shaft which is rotatable in a first direction; and a second shaft which is rotatable in a second direction, said second direction being opposite of said first direction, said second shaft being coupled to said first shaft with a chain that is a continuous loop chain, said chain having an inside engaging said second shaft and an outside engaging said first shaft, said chain rotating in a single rotational direction;

wherein:

said constant first actuator diameter is equal to said constant second actuator diameter;

said first actuator first clutch, said first actuator second clutch, said second actuator first clutch and said second actuator second clutch are each one way clutches;

said first actuator is coupled to said first shaft with said first actuator first clutch and is coupled to said second shaft with said first actuator second clutch; and said second actuator is coupled to said first shaft with said second actuator first clutch and is coupled to said second shaft with said second actuator second clutch.

11. A heat engine comprising:

a first actuator having a head movable between a first end position at a first actuator first end, a second end position at a first actuator second end and a between position between said first actuator first end and said first actuator second end;

wherein when said head is in said between position, said first actuator has a between volume and a between pressure;

when said head is in said second end position, said first actuator has a second end pressure and a second end volume;

wherein said second end pressure is equal to an ambient pressure when said first actuator is opened to the ambient pressure;

a second actuator; and a shaft;

wherein:

said first actuator has a first actuator output that decreases along a first actuator stroke after a first actuator input valve closes and said second actuator has a second actuator output that decrease along a second actuator stroke after a second actuator input valve closes;

said first actuator and said second actuator are connected to said shaft and said first actuator output is cumulative with said second actuator output;

said first actuator is operable independent of said second actuator; and said first actuator is operable in an offset phase relative to said second actuator whereby a heat engine output is leveled as a result of said offset phase.

12. The heat engine of claim 6 wherein:

said first actuator is operable with a first actuator first clutch and a first actuator second clutch;

said second actuator is operable with a second actuator first clutch and a second actuator second clutch;

said first actuator first clutch, said first actuator second clutch, said second actuator first clutch and said second actuator second clutch are each one way clutches;

said first actuator is coupled to said first shaft with said first actuator first clutch and is coupled to said second shaft with said first actuator second clutch; and said second actuator is coupled to said first shaft with said second actuator first clutch and is coupled to said second shaft with said second actuator second clutch;

whereby said first actuator applies a first actuator force and said second actuator applies a second actuator force, said second actuator force being cumulative with said first actuator force.

13. The heat engine of claim 10 wherein:

said first actuator head is movable between a first end position at a first actuator first end, a second end position at a first actuator second end and a between position between said first actuator first end and said first actuator second end;

when said first actuator head is in said between position, said first actuator has a between volume and a between pressure; and when said first actuator head is in said second end position, said first actuator has a second end pressure and a second end volume, said second end pressure being equal to an ambient pressure when said first actuator is opened to the ambient pressure.

14. The heat engine of claim 13, wherein said first actuator further comprises an input valve, said input valve being open from when said first actuator head is in said first end position until said first actuator head is in said between position.

15. The heat engine of claim 10 further comprising a first position gear and a second position gear, wherein said inside of said chain engages said first position gear and said second position gear.

16. The heat engine of claim 15, wherein said first position gear is adjustably supported relative to a slot, whereby position of said first position gear relative to said slot determines an amount of tension force applied to said chain.

17. The heat engine of claim 10, wherein said first actuator is operable independent of said second actuator, and said first actuator has an offset phase from said second actuator.

18. The heat engine of claim 10 further comprising a third actuator and a fourth actuator.

* * * * *